US005585804A

United States Patent [19]

Rodeffer

[11] Patent Number: 5,585,804

[45] Date of Patent: Dec. 17, 1996

[54] METHOD FOR AUTOMATICALLY POSITIONING A SATELLITE DISH ANTENNA TO SATELLITES IN A GEOSYNCHRONOUS BELT

[75] Inventor: Charles E. Rodeffer, Burlington, Iowa

[73] Assignee: Winegard Company, Burlington, Iowa

[21] Appl. No.: 510,991

[22] Filed: Aug. 3, 1995

Related U.S. Application Data

[63] Continuation-in-part of Ser. No. 210,160, Mar. 17, 1994, Pat. No. 5,471,219, which is a continuation of Ser. No. 978,289, Nov. 18, 1992, Pat. No. 5,296,862.

[51] Int. Cl.[6] ..... H01Q 3/00

[52] U.S. Cl. ..... 342/359

[58] Field of Search ..... 342/359, 352

[56] References Cited

U.S. PATENT DOCUMENTS

| | | | |
|---|---|---|---|
| 4,602,259 | 7/1986 | Shepard | 342/359 |
| 4,783,848 | 11/1988 | Ma et al. | 455/182 |
| 4,785,302 | 11/1988 | Ma et al. | 342/362 |
| 4,801,940 | 1/1989 | Ma et al. | 342/359 |
| 4,888,592 | 12/1989 | Paik et al. | 342/359 |
| 4,907,003 | 3/1990 | Marshall et al. | 342/352 |
| 5,077,560 | 12/1991 | Horton et al. | 342/359 |
| 5,077,561 | 12/1991 | Gorton et al. | 342/359 |
| 5,296,862 | 3/1994 | Rodeffer et al. | 342/359 |

*Primary Examiner*—Gregory C. Issing
*Attorney, Agent, or Firm*—Dorr, Carson, Sloan & Birney, P.C.

[57] ABSTRACT

A TVRO satellite dish antenna system mounted on the roof of a parked vehicle automatically determines its location and bearing relative to two geosynchronous satellites and then uses this information to accurately calculate the azimuths and elevations of any other geosynchronous satellites. A magnetic compass generates a magnetic bearing signal for the system. An estimated latitude and longitude for the vehicle are provide by the user based on the approximate geographic location of the vehicle. The estimated positions for a first geosynchronous satellite and a second geosynchronous satellite relative to the satellite dish antenna are calculated from this information. The satellite dish antenna is moved to an initial search position corresponding to the estimated position of the first satellite and then moved in a search pattern until the receiver detects a signal peak for a selected channel. The actual azimuth and elevation of the first satellite are calculated based on the position of the satellite dish antenna upon detecting the signal peak. These steps are repeated for the second satellite. Revised bearing, latitude, and longitude coordinates for the satellite dish antenna are calculated based on the actual azimuths and elevations of the first and second satellites. Finally, the azimuth and elevation of any remaining geosynchronous satellite can be calculated based on the revised bearing, latitude, and longitude coordinates for the satellite dish antenna.

13 Claims, 18 Drawing Sheets

Fig. 4

SET TARGET POSITIONS (400)

1 CITY = BURLINGTON , IA (410)
2 RV LATITUDE = 42.10 (420)
3 RV LONGITUDE = 90.10 (430)
4 COMPASS OVERIDE = ON (440)
5 COMPASS HEADING = 15 (450)
6 CHANGE SEARCH CHARACTERISTIC
SEARCH SAT. = ANIK E2
SEARCH CHAN = 6
SEARCH FREQ. = 5410 (460)
7 CALCULATE NEW SAT POSITIONS.
8 CALCULATE POLARITIES. = YES
9 SEARCH FOR SATELLITE

Fig. 5

CITY MENU (500)

| CITY | ST | LAT | LON |
|---|---|---|---|
| TAMPA | FL | 28.0 | 82.50 |
| ATLANTA | GA | 33.60 | 84.40 |
| SAVANNA | GA | 32.10 | 81.20 |
| BURLINGTON | IA | 41.80 | 91.10 |
| SIOUX CITY | IA | 42.40 | 96.40 |
| BOISE | ID | 43.60 | 116.20 |
| CHICAGO | IL | 42.0 | |

(510)

PRESS SELECT TO USE THE HIGHLIGHTED CITY.
PRESS QUIT TO EXIT MENU.

Fig. 6

SEARCH MENU (600)

| SATELLITE | CHANNEL | AUDIO |
|---|---|---|
| ANIK E2 | 6 | 5410 |
| ANIK E2 | 1 | 7800 |
| GALAXY | 13 | 5760 |
| TELS 301 | 3 | 5800 |
| GALAXY 1 | 3 | 6480 |
| SPACENET 1 | 17 | 7560 |
| GALAXY 3 | 24 | 5400 |
| SPACENET 3 | 9 | 5940 |
| SATCOM 4 | 15 | 5800 |
| SPACNET 2 | 23 | 5800 |
| ANIK E2 | 23 | 5410 |
| ANIK D2 | 15 | 5940 |

(610)

PRESS HELP FOR HELP

Fig. 11(a)
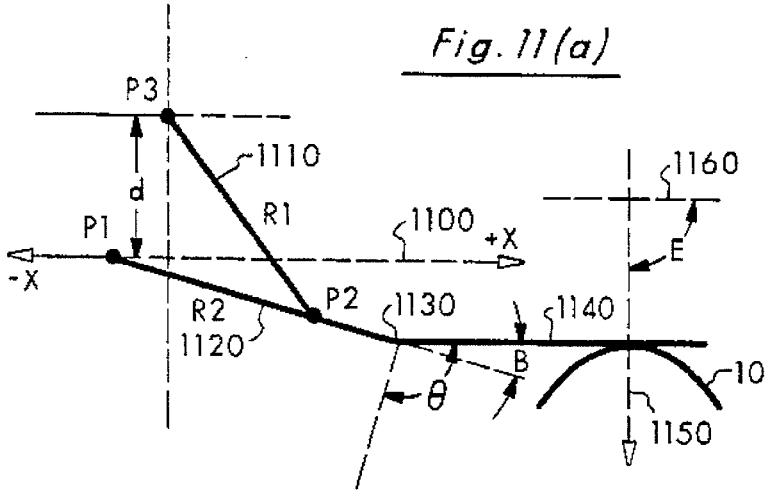
Fig. 11(b)
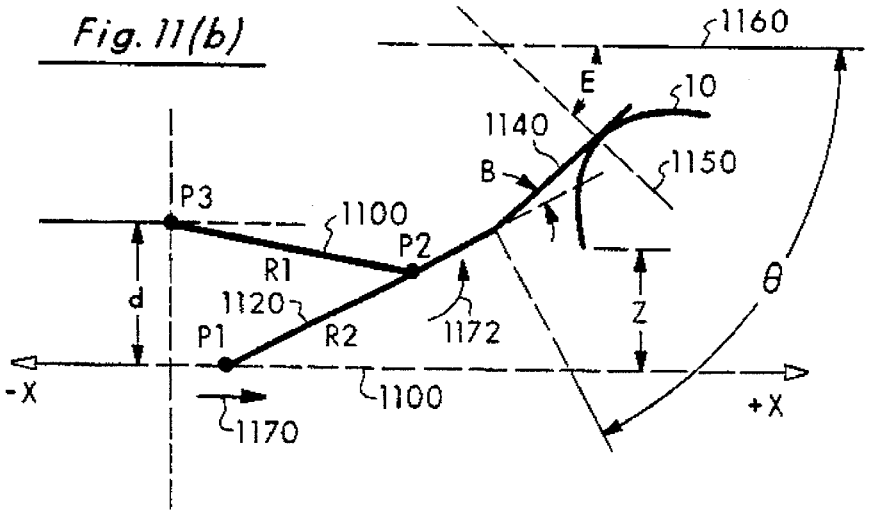
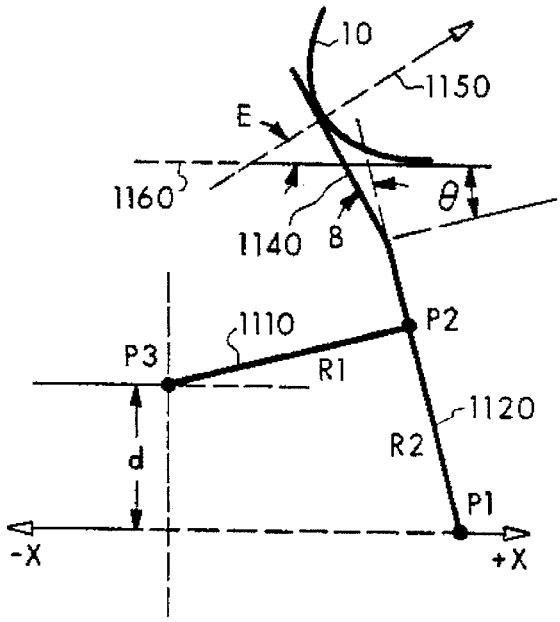
Fig. 11(c)

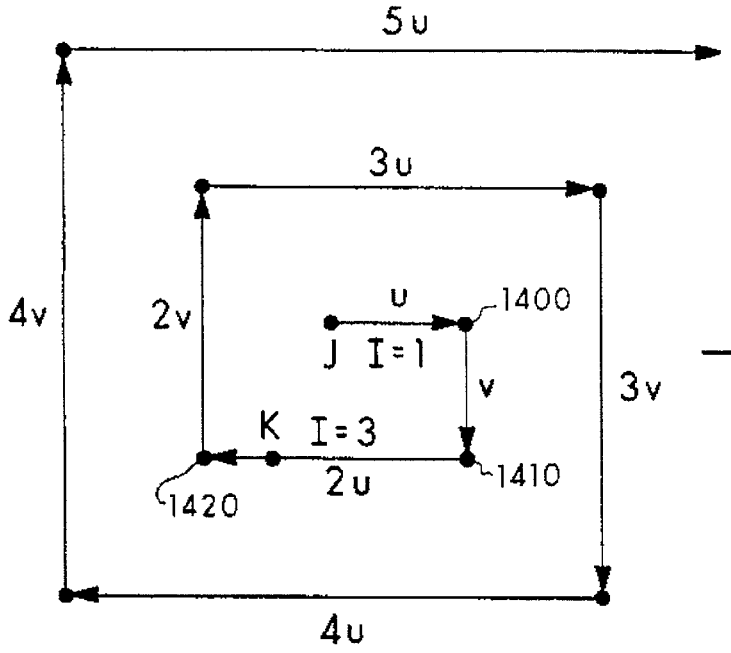
Fig. 14
Fig. 17
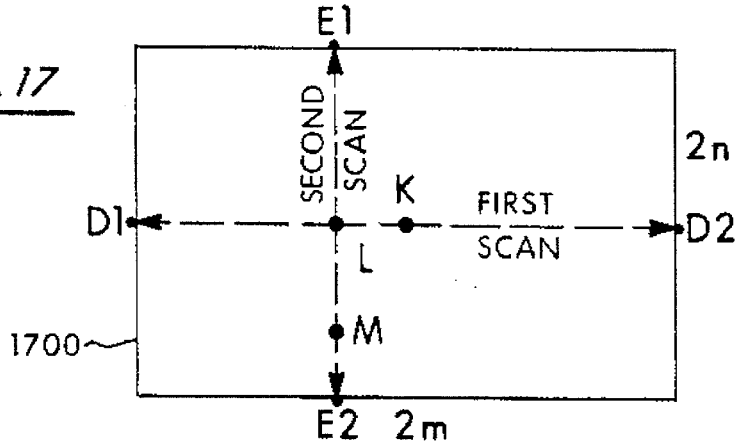
Fig. 19
SEARCH PARAMETER MENU
--> AZ SPIRAL (CNTS) = 60
EL SPIRAL (CNTS) = 90
SCAN STEPS = 14
SAMPLES INC./STEP = 12
AZ FINE WNDW (CNTS) = 50
AZ FINE SAMPLES = 100
EL FINE WNDW (CNTS) = 75
EL FINE SAMPLES = 150
AZ CNTS/DEGREE = 10
AZ FOUND (DEGREES) = 1.0
AZ RANGE (DEGREES) = 5.0
EL CNTS/DEGREE = 15
EL FOUND (DEGREES) = 1.0
EL RANGE (DEGREES) = 5.0
SIGNAL THRESHOLD = 3

760
EXECUTE SEARCH
START
1500
I = 1
1510
MOVE DISH ALONG SCAN STEP 1.
1514
TAKE DATA READING?
1518
Yes
No
READ & STORE SIGNAL STRENGTH
1520
END OF SCAN STEP?
1524
Yes
No
STOP ANTENNA MOVEMENT
1528
PROCESS DATA TAKEN DURING SCAN
1530
SATELLITE FOUND?
1534
No
Yes
MOVE DISH TO SATELLITE
1544
FINE TUNE DISH LOCATION
1550
FINE TUNE WORKED?
1560
No
Yes
INCREMENT 1
1538
I > SCAN STEPS ALLOWED ?
1540
No
Yes
SATELLITE NOT FOUND
SATELLITE FOUND
1570
END

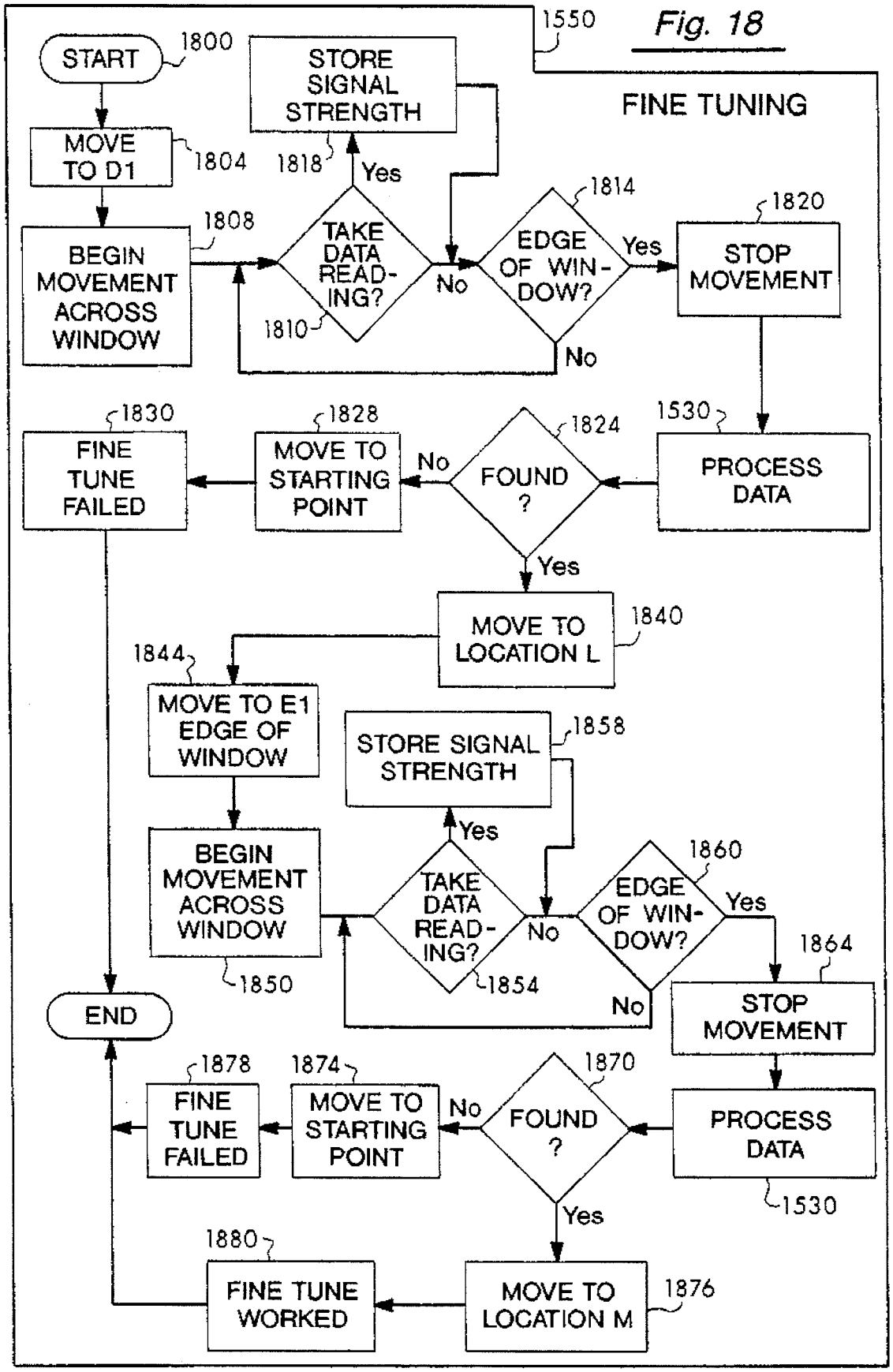
Fig. 18
1550
FINE TUNING
START
1800
MOVE TO D1
1804
BEGIN MOVEMENT ACROSS WINDOW
1808
TAKE DATA READ-ING?
1810
Yes
No
STORE SIGNAL STRENGTH
1818
EDGE OF WIN-DOW?
1814
Yes
No
STOP MOVEMENT
1820
PROCESS DATA
1530
FOUND ?
1824
No
Yes
MOVE TO STARTING POINT
1828
FINE TUNE FAILED
1830
MOVE TO LOCATION L
1840
MOVE TO E1 EDGE OF WINDOW
1844
BEGIN MOVEMENT ACROSS WINDOW
1850
TAKE DATA READ-ING?
1854
Yes
No
STORE SIGNAL STRENGTH
1858
EDGE OF WIN-DOW?
1860
Yes
No
STOP MOVEMENT
1864
PROCESS DATA
1530
FOUND ?
1870
No
Yes
MOVE TO STARTING POINT
1874
FINE TUNE FAILED
1878
END
MOVE TO LOCATION M
1876
FINE TUNE WORKED
1880

Start
Input Data & Calc. Est. Positions of S1 & S2
2401
Search for Actual Positions of S1 & S2
2402
2403
Elevations Correct?
No
Yes
2404
Calc. Latitude and Longitude From Actual Positions of S1 & S2
Calc. New Azimuths for S1 & S2
2405
2406
Azimuths Correct?
No
Yes
2407
Adjust Bearing
2408
Azimuths Correct?
No
Yes
2409
Not level. Use Single Satellite to Approximate Orbit
2410
Calc. Positions of Other Satellites
Done

METHOD FOR AUTOMATICALLY POSITIONING A SATELLITE DISH ANTENNA TO SATELLITES IN A GEOSYNCHRONOUS BELT

RELATED APPLICATIONS

The present application is a continuation in part of the applicants' U.S. patent application Ser. No. 08/210,160, filed on Mar. 17, 1994, now U.S. Pat. No. 5,471,219 which is a continuation of Ser. No. 8/978,289 filed Nov. 18, 1992 now U.S. Pat. No. 5,296,862, issued on Mar. 22, 1994.

BACKGROUND OF THE INVENTION

1. Field of the Invention

The present invention relates generally to the field of television receive-only (TVRO) satellite dish antennas. More specifically, the present invention discloses a method for automatically positioning a satellite dish antenna mounted on a parked vehicle, such as a recreational vehicle, to locate geosynchronous satellites in the Clarke belt.

2. Statement of the Problem.

Over the past decade, TVRO antennas have grown substantially in popularity and are typically found in geographic areas of the United States where cable or broadcast television is not prevalent. Substantial programming exists on a number of satellites positioned in the Clarke belt, usually offering high quality programming through a paid descrambling system. Such commercially available programming from these satellites has found growing popularity among recreational vehicle (RV) users who would like to tap into this programming during their trips around the country in recreational vehicles. Initial satellite TVRO systems for recreational vehicles were simply comprised of a small TVRO dish antenna placed on the ground near the RV. The dish antenna was then manually adjusted with great care and time to locate and tune into an individual satellite. The tuning process would be repeated for tuning into another satellite. This approach was somewhat effective but resulted in considerable set-up time by the consumer and usually resulted in low quality signals in the television set.

Some satellite dish antennas are designed to mount directly on the roof of the recreational vehicle. This eliminates the need for placement and storage of the satellite dish antenna such as described above. However, the alignment of the mounted satellite dish antenna to the satellite was still difficult due to the manual adjustments involved. An example of this type of conventionally available system is manufactured by RV Satellite Systems, 2356 South Sara Street, Fresno, Calif. 93706 under the trademark "BEST MADE." This antenna is designed to be raised and lowered from inside the RV and to be easily tuned into the satellite desired. The raising, lowering, and positioning of the dish antenna is done manually using a mechanical link between the inside and outside of the RV.

A goal of TVRO satellite systems for use on RVs has been to fully automate the set-up and tuning of the dish antenna to all of the satellites. One conventionally available system providing semi-automatic set-up is manufactured by Elkhart Satellite Systems, 23663 U.S. Highway 33, Elkhart, Ind., 46517, which carries the trademark "MOTO-SAT." This system utilizes an electronic compass.

Another conventional RV satellite dish antenna providing semi-automatic positioning is manufactured by The Dometic Corporation, 609 South Poplar Street, LaGrange, Ind., 46716. This system is manufactured under the trademark "A&E TRAVEL-SAT." The satellite dish antenna is mounted on the roof of the RV. When the RV is parked at a location such as a campsite, the RV is leveled and stabilized. The operator of the system uses a compass located at least six feet in front of the coach to ascertain the present compass heading of the coach (and therefore, of the antenna). The user turns on the receiver and the TV. The TV is set to a predetermined channel. The user then keys in the present compass heading into the system controller. The user refers to a "viewer's guide" to find the azimuth and elevation readings of the city nearest the campsite where the RV is parked. These coordinates correspond to the G1 satellite and are entered into the system controller by the user. The user presses the "aim" button on the system controller and the dish commences to move. As the dish moves, the user must closely watch the TV screen and, upon seeing a quick flash of an image across the screen, press the stop button on the controller. The user then presses "left" and "right" and "up" and "down" buttons to fine-tune the satellite dish into the image. After particular satellite is found, it must be identified so that the other satellites can be found. While this system provides an improvement over the earlier manual alignment approaches, it still involves substantial user interaction and time. It also requires the user's perception to watch for the images on the TV screen. The RETRIEVER™ system made by Vicor Industries, Inc. of Mission Viejo, Calif. 92690, follows an approach similar to the above.

A wide variety of positioning systems have been used in the past for satellite dish antennas, including the following:

| Inventor | Patent No. | Issue Date |
|---|---|---|
| Rodeffer et al. | 5,296,862 | Mar. 22, 1994 |
| Horton et al. | 5,077,560 | Dec. 31, 1991 |
| Gorton et al. | 5,077,561 | Dec. 31, 1991 |
| Marshall et al. | 4,907,003 | March 6, 1990 |
| Ma et al. | 4,801,940 | Jan. 31, 1989 |
| Ma et al. | 4,785,302 | Nov. 15, 1988 |
| Ma et al. | 4,783,848 | Nov. 8, 1988 |
| Shepard | 4,602,259 | July 22, 1986 |

In the parent of the present application, Rodeffer et al. disclose a method for automatically positioning a satellite dish antenna on a parked vehicle for geosynchronous satellites. The satellite dish antenna is moved to an initial search position based on a bearing provided by a magnetic compass and approximate longitude and latitude values selected by the user using the approximate geographic location of vehicle. The satellite dish antenna is then moved in a search pattern to detect a signal peak for a selected audio subcarrier frequency in a selected channel of a target geosynchronous satellite. The frequency selected is not present in corresponding channels of other satellites near the target satellite. The azimuth and elevation positions of all remaining satellites can then be calculated.

Horton et al. disclose an automatic drive for a TVRO antenna. The receiver calculates the position of each geosynchronous satellite. The antenna dish is initially pointed at each satellite and a peaking routine under operator control then maximizes signal strength for each satellite. These "peaked" positions are stored and subsequently used to repoint the antenna at each of the satellites during normal day-to-day operation.

Gorton et al. disclose a computerized antenna mount system for continuously tracking a geosynchronous satellite that has an inclined orbit with respect to the equator. The antenna mount automatically adjusts the declination angle of the ground station satellite antenna as a function of time after iteratively compiling the declination angle history from one complete orbit of a satellite.

Marshall et al. disclose a satellite receiver and acquisition system that uses an antenna search routine to maximize signal strength during setup.

U.S. Pat. No. 4,801,940 to Ma et al. discloses another example of a satellite-seeking system for a TVRO antenna.

U.S. Pat. No. 4,785,302 to Ma et al. discloses an automatic polarization control system for TVRO receivers.

U.S. Pat. No. 4,783,848 to Ma et al. discloses a TVRO receiver system for automatically locating audio signals among various audio subcarriers received from different transponders without the need for manual scanning.

Shepard discloses another example of a polar mount for a parabolic satellite-tracking antenna.

Solution to the Problem

None of the prior art references uncovered in the search show a TVRO satellite dish antenna system mounted on the roof of a parked vehicle that automatically determines its location and bearing relative to two geosynchronous satellites and uses this information to accurately calculate the azimuth and elevation position of any other geosynchronous satellite. The use of two geosynchronous satellites provides greater assurance that the location and bearing of the vehicle have been accurately determined. If only one geosynchronous satellite is used, all errors in the estimated location and bearing of the vehicle are lumped into one correction factor that is then used in calculating the relative angles for all other satellites. However, this single correction factor may be inaccurate for other satellites. For example, a combination of errors in the estimated location, bearing, and leveling of the vehicle might offset one another if only one geosynchronous satellite is used, thereby leading to the false indication that the system has been properly set up.

SUMMARY OF THE INVENTION

This invention provides a TVRO satellite dish antenna system mounted on the roof of a parked vehicle that automatically determines its location and bearing relative to two geosynchronous satellites and uses this information to accurately calculate the azimuths and elevations of any other geosynchronous satellite. A magnetic compass generates a magnetic bearing signal for the system. An estimated latitude and longitude for the vehicle are provide by the user based on the approximate geographic location of the vehicle. The estimated position for a first geosynchronous satellite relative to the satellite dish antenna is calculated from this information. The satellite dish antenna is moved to an initial search position corresponding to the estimated position of the first satellite and then moved in a search pattern until the receiver detects a signal peak for a selected channel. The actual azimuth and elevation of the first satellite are calculated based on the position of the satellite dish antenna upon detecting the signal peak. These steps are repeated for a second geosynchronous satellite. Revised bearing, latitude, and longitude coordinates for the satellite dish antenna are calculated based on the actual azimuths and elevations of the first and second satellites. Finally, the azimuth and elevation of any remaining geosynchronous satellite can be calculated based on the revised bearing, latitude, and longitude coordinates for the satellite dish antenna.

A primary object of the present invention is to provide a TVRO dish antenna system for use on vehicles that can be automatically positioned relative to geosynchronous satellites without requiring the user to provide detailed information concerning the bearing, longitude, and latitude of the vehicle.

Another object of the present invention is to provide a TVRO dish antenna system for use on vehicles that can be quickly and easily positioned relative to geosynchronous satellites with a minimum of involvement by the user.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 4 sets forth the target menu of the present invention.

FIG. 5 sets forth the city menu of the present invention.

FIG. 6 sets forth the search menu of the present invention.

FIGS. 11(*a*)–(*c*) set forth the geometric relationships through which the antenna of the present invention goes as it opens from a clasped position to a position for the detection of the target satellite.

FIG. 14 sets forth the rectangular spiral gross search pattern of the present invention.

FIG. 17 sets forth the fine tune search pattern.

FIG. 18 sets forth the fine tuning flow chart.

FIG. 19 sets forth the search parameter menu.

DETAILED DESCRIPTION OF THE INVENTION

1. Overview

Figure 1:
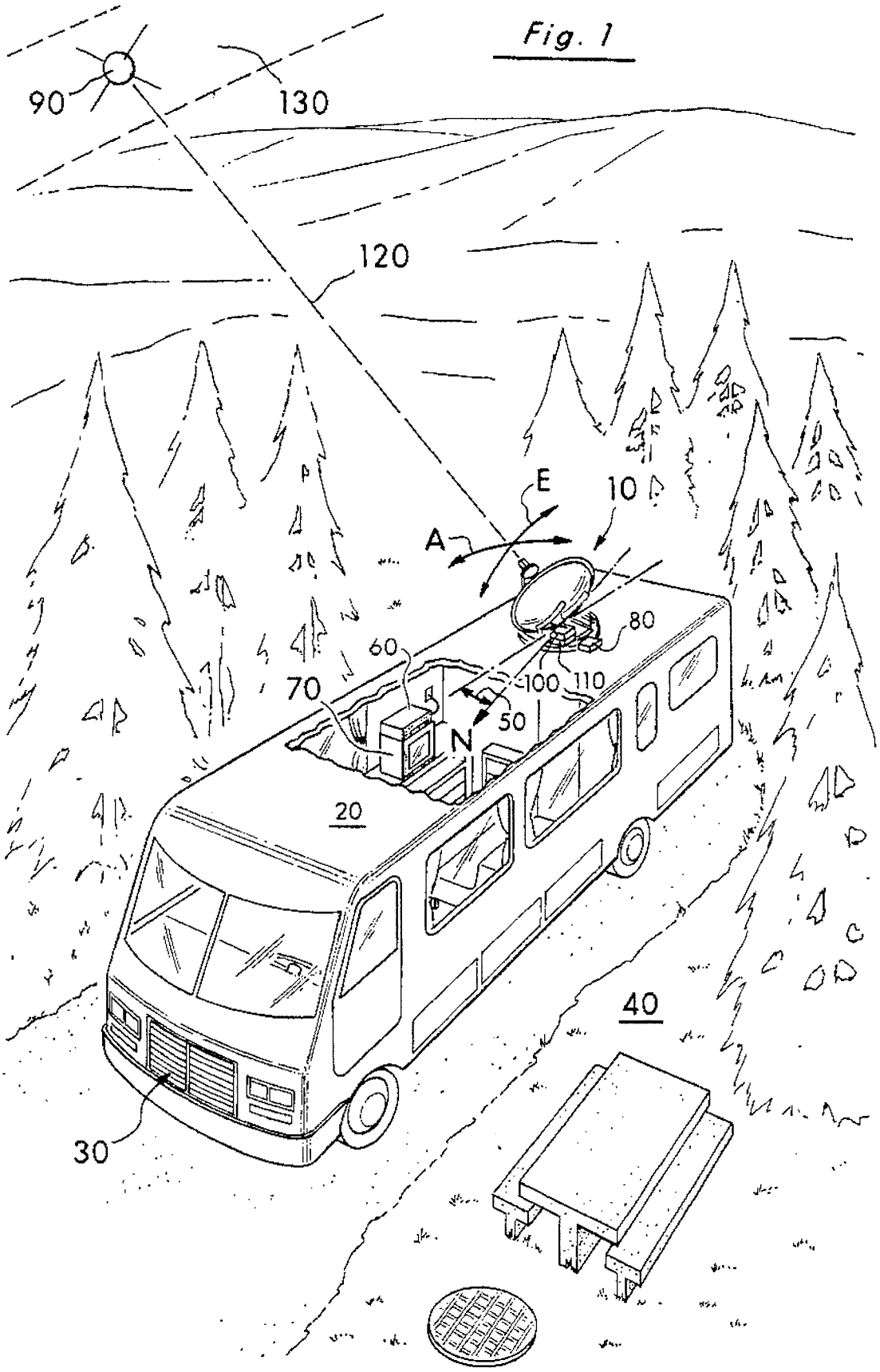
FIG. 1 is a perspective view of the TVRO system adapted for use on a recreational vehicle.

In FIG. 1, the satellite dish antenna 10 of the present invention is mounted to the roof 20 of a recreational vehicle 30 that is parked at a campsite 40. The vehicle 30 is oriented in a direction that is displaced from true north by an angular direction Θ indicated by arrows 50. The antenna 10 is connected to a receiver 60 that in turn is connected to a television 70. While the present invention finds application for use on any vehicle, in the preferred embodiment the vehicle is a recreational vehicle (RV), and the following disclosure will only refer to use on an RV. However, the scope of the invention is not to be limited to use on an RV. In fact, the present invention could be mounted on a building, but the invention is most suitably useful on vehicles that move from location to location. Hence, the term "vehicle" is used to mean any "carrier" that can move from location to location so as to have different longitudes and latitudes. The term "object" would include a carrier and a fixed support such as a building.

In operation, the satellite dish antenna 10 is folded in a downward position while the RV 30 is moving to the campsite 40. When the RV 30 is parked at the campsite 40, the user activates the receiver 60 and the dish antenna 10 unfolds. The user inputs the city location into the receiver 60 based on a menu or list of cities appearing on the TV 70. The inputting of the city location by the user provides the latitude and longitude to the receiver 60. A magnetic compass 80 mounted on the mount of the satellite dish antenna 10 is automatically read by the receiver 60 to provide angular deviation data Θ from true north (i.e., termed a "direction signal"). Based on the manually entered latitude and longitude values and the generated electronic compass reading 80, the satellite dish antenna 10 is automatically moved in the azimuth and elevation directions to the general direction of a target satellite 90 (i.e., the initial search position).

The satellite dish antenna 10 under control of the receiver 60 changes elevation E under control of an elevation motor 100 and changes azimuth direction A under control of an azimuth motor 110. This type of mount is conventional and is well known in the industry as an azimuth/elevation (AZ-EL) type of mount. With the satellite dish antenna in the initial search position, a predetermined rough-tune search pattern is first used by receiver 60 to ascertain the presence of a first peak signal from a selected audio subcarrier frequency (i.e., 5.14 MHz) appearing in a selected channel (i.e., Ch. 6) of the target satellite 90 (i.e., ANIK-E2). If a first peak signal is found in the rough-tune search, a finetune search pattern is then used by receiver 60 to precisely locate a second peak signal for the selected audio subcarrier. The satellite dish antenna 10 is now properly positioned along a boresight 120 to receive signals from the target satellite 90. At this time, the target satellite 90 is identified and the locations (i.e., azimuth and elevation positions) of all of the other satellites in the Clarke belt 130 can be precisely located by the receiver 60.

The user interacts with the system only to turn the receiver 60 on and to enter the location through a menu select. Otherwise, the receiver 60 of the present invention, based on the entered location and the compass reading, automatically (1) unfolds the antenna to an approximate boresight for a selected satellite 90 based on the location and compass reading; (2) performs the rough-tune search that roughly locates the boresight of the antenna to a selected audio subcarrier signal; and (3) performs the fine-tune search that precisely locates the boresight 120 of the antenna 10 to receive the audio signal.

The system of the present invention is designed to be extremely "user-friendly" in locating satellites in the geosynchronous Clarke belt. As discussed next, the user simply parks the RV and enters the approximate latitude and longitude. The system will automatically find a preprogrammed target satellite. Once the target satellite has been found, all the other satellite locations are automatically calculated.

2. Receiver 60

Figure 2:
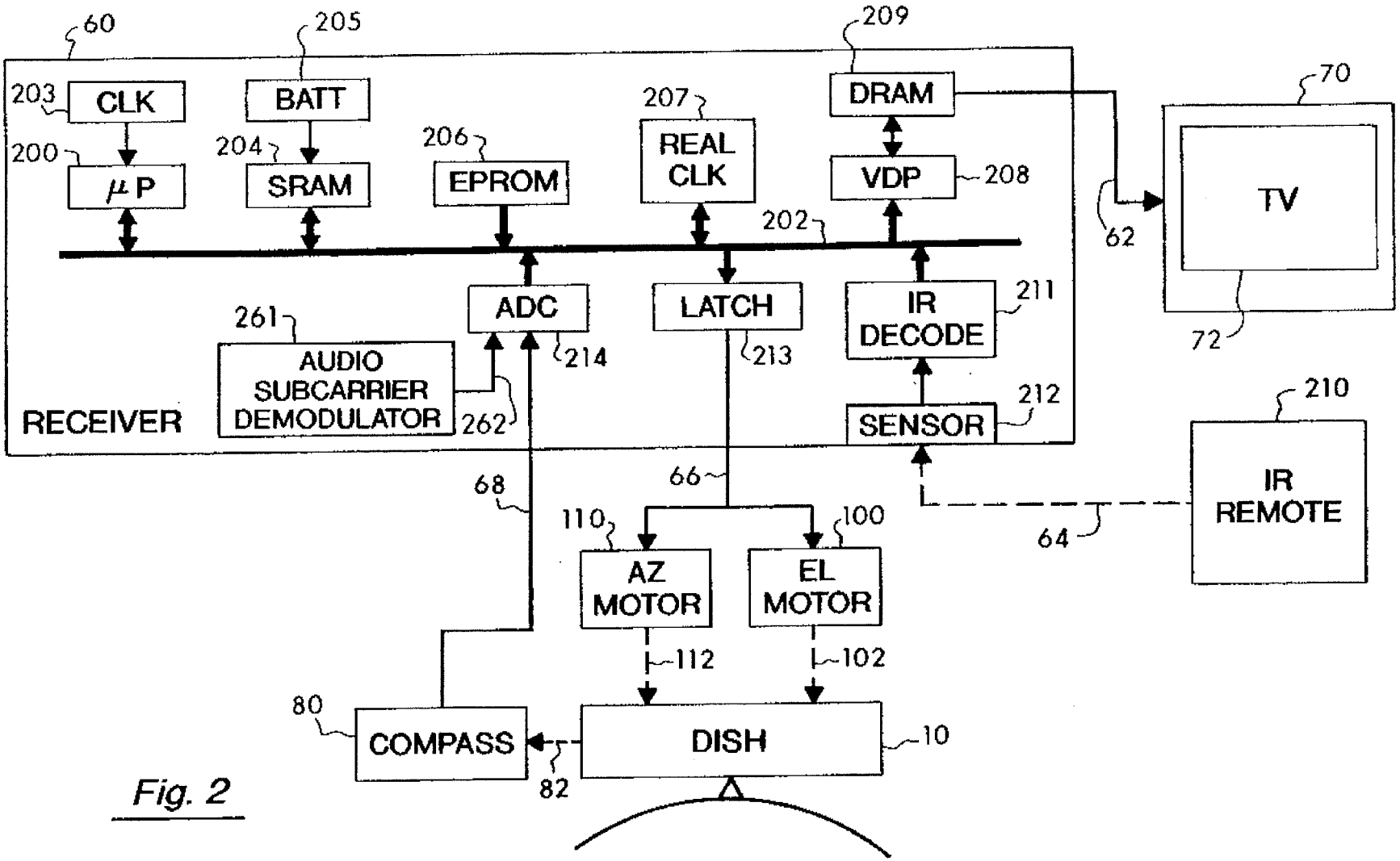
FIG. 2 is a block diagram of the electronic and electrical components of the present invention.

In addition to having the standard electronic circuitry for TVRO tuning and reception including the descrambling circuitry, the receiver 60 of the present invention, as shown in FIG. 2, includes a microprocessor 200 and associated digital electronics described in the following.

The receiver 60 is interconnected to the television set 70 over lines 62 so as to display graphics on the screen 72 of the television. The receiver 60 also receives transmitted signals 64 from a remote control 210. The remote control 210, under the preferred embodiment, is an infrared (IR) remote control (pulse-position modulation), although it is to be expressly understood that this input device could comprise buttons on the TV 70, on the receiver 60, or on a separate electronics package; in which event, the link 64 would most likely be electrical wires. The receiver 60 is also interconnected over lines 66 to the elevation motor 100 and to the azimuth motor 110, both of which are mechanically interconnected to the TVRO dish 10 over mechanical links 102 and 112, respectively. The receiver 60 is also connected over lines 68 to an electronic compass 80 that is mechanically connected 82 to the dish antenna 10. The compass 80 is a magnetoflux compass and is hard mounted to the AZ-EL mount so that the compass accurately measures the magnetic direction of the mount. The compass 80 measures the approximate heading or direction of the mount (or RV). The antenna 10 is a 4.5 foot parabolic mesh antenna.

In general operation, the receiver 60 provides graphic communications in the form of screen menus to the monitor 72 of TV 70 over lines 62. The user of the present invention uses the remote 210 or other comparable input device to deliver signals over communication pathway 64 to the receiver 60 in response to queries in the menus on TV 70. For example, a directory of cities could be displayed in the monitor of TV 70 and the user of the present invention could use the remote 210 to select a given city. Based on that city's selection, the receiver 60 (in response to a reading from the electronic compass 80 delivered over lines 68) would issue motor control signals over lines 66 to the azimuth motor 110 and to the elevation motor 100, which would then mechanically position dish 10 in the general direction of the target satellite 90 in the Clarke belt 130.

The receiver 60 as shown in FIG. 2 uses a central bus 202 that conventionally comprises address, data, and control busses. The microprocessor 200 is interconnected to bus 202. In the present invention, the microprocessor 200 is a 16-bit microprocessor such as the Model 68008 manufactured by Motorola. A clock 203 is used to provide clock signals to the microprocessor 200. In the preferred embodiment the conventional clock is a 5.365 MHz clock.

Also connected to the bus 202 is a static random access memory (SRAM) 204. A lithium battery 205 is used to provide power backup to the SRAM 204. The SRAM 204 holds all channel information for each of the 36 channels and for up to 36 satellites (1296 channels total). The SRAM 204 also holds all satellite position information (such as label, azimuth position, elevation position, and orbital position). The channel and position information is loaded into the SRAM 204 at manufacture. The SRAM 204 also holds the variable information as will be explained later. In the preferred embodiment, the conventional SRAM 204 is a 32K by 16 bit memory.

Also connected to bus 202 is an electronic programmable read-only memory (EPROM) 206 that contains the software necessary to operate the system of the present invention. The EPROM 206 is preferably 128K bytes in size. A real time clock 207 is conventionally interconnected to a bus 202. A conventional video display processor (VDP) 208 is interconnected to the bus 202 and a conventional video dynamic random access memory (DRAM) 209 is also interconnected. The output of the DRAM 209 is delivered over lines 62 to a conventional on-screen display (OSD) video output. The VDP 208 works in conjunction with the microprocessor 200 to generate full-screen menus that the user sees when operating the receiver 60. The microprocessor 200 writes information into the DRAM 209, and the VDP 208 processes the contents of this memory and converts it to video. It is with these menus, as illustrated later, working in conjunction with the IR remote 210 that the user operates the receiver 60. Preferably there are no front panel controls or displays on the receiver 60 itself.

Also connected to bus 202 is the infrared decode circuit 211, which is conventionally interconnected to an IR sensor 212. Both components are conventionally available. A latch 213 is connected to the bus 202; in the preferred embodiment this is an 8 bit latch. A conventional eight bit analog/digital circuit (ADC) 214 is interconnected over lines 68 with the electronic compass 80.

The operation of the hardware configuration set forth in FIG. 2 will be more fully explained in the following. Generally speaking, the microprocessor 200 based on programming appearing in EPROM 206 activates the VDP 208 to display in the TV 70 predetermined screen menus. The IR decode circuit 211 receives operator commands from the remote device 210 so as to cause the microprocessor 200 to follow the correct operating sequence desired by the user. The microprocessor 200, by loading proper data in latch 213, can precisely cause the azimuth motor 110 to move incrementally in the azimuth direction and can cause the elevation motor 100 to move incrementally in the elevation direction. The microprocessor 200 can obtain the precise heading of the dish 10 by reading the ADC circuit 214, which carries the compass reading 80.

In FIG. 2, the details of the conventional receiver operation are not set forth. One aspect of the present invention is the ability to tune into an audio subcarrier during a rough and fine tune search as will be discussed later. The circuitry for receiving and tuning is conventional; however, the conventional audio subcarrier demodulator 261 has been modified to deliver the analog signal of the subcarrier over line 262 into the ADC 214 so that the corresponding digital value of the signal can be used by the microprocessor 200 in the search process.

The receiver 60 circuitry set forth in FIG. 2 is a preferred embodiment. It is to be expressly understood that variations to this circuitry could be made by one skilled in the art under the teachings of the present invention.

3. System Operation

Figure 3:
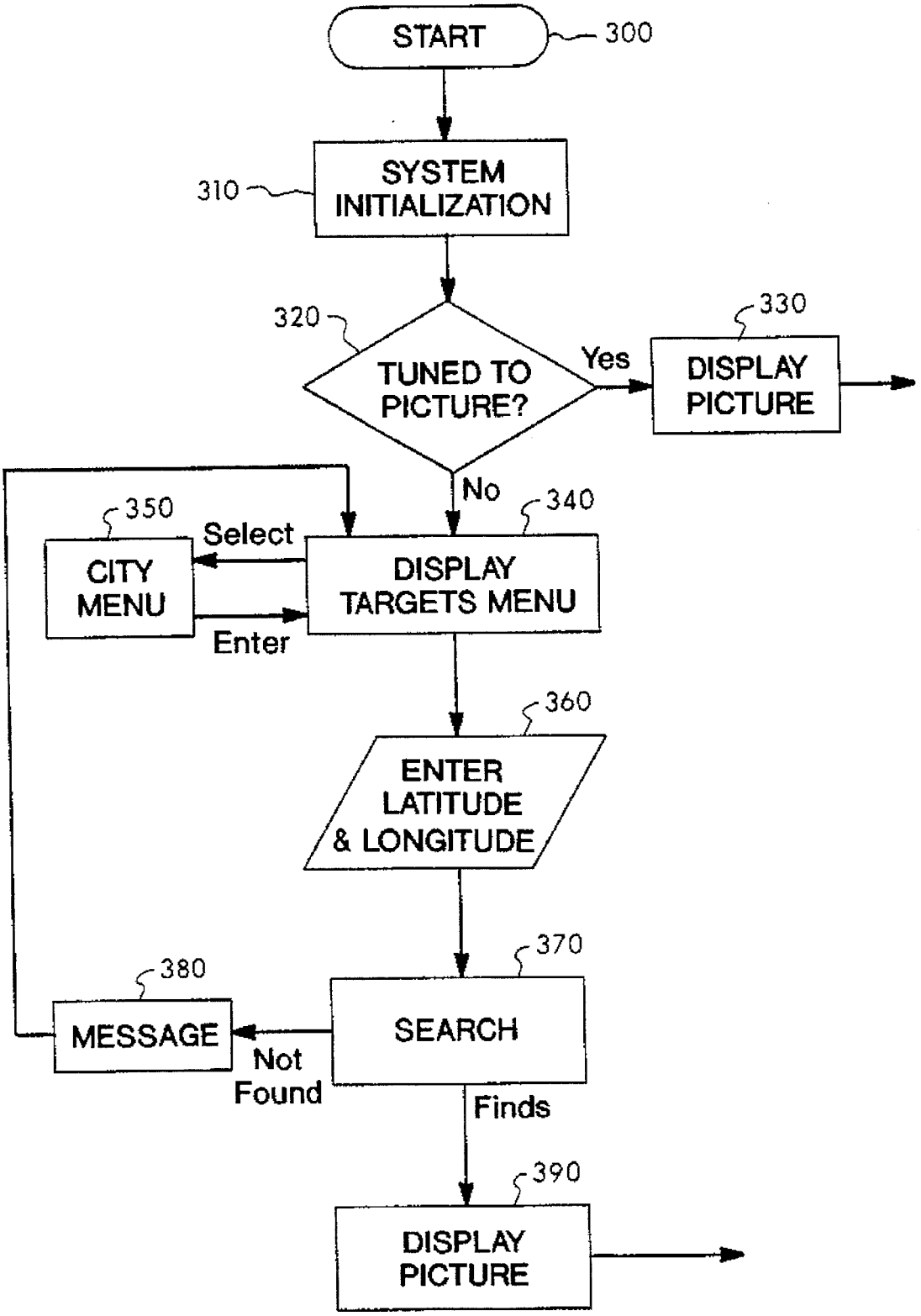
FIG. 3 sets forth the system activation flowchart of the present invention.

In FIG. 3, the overall system operation is shown. The operator turns on the system at stage 300. That is, the user turns on the receiver 60 and the television 70. The system becomes initialized in stage 310.

In stage 310, the satellite dish antenna 10 unfolds from the traveling position and orients to an initial position. This initial position would be, for example, the last position in which the antenna 10 was oriented by the user in order to receive a picture from the antenna 10 (i.e., the night before at a different campsite). If the RV 30 had not moved to a new location and was still in the same position, the antenna 10 would simply position to the last viewed satellite. In stage 320, therefore, if the dish antenna 10 is already tuned to a satellite 90 and a picture is received, stage 330 is entered and the tuning process is complete. The user will conventionally view the TV 70 and move from satellite to satellite and from transponder to transponder in a conventional fashion. However, if the dish antenna 10 is not tuned to a transponder, stage 340 is entered and the target menu is displayed. In FIG. 4, an example of a target menu is shown.

In FIG. 4, the target menu 400 is displayed on TV 70. As shown in FIG. 4, a city field 410, a latitude field 420, a longitude field 430, a compass heading 450, and several search characteristics fields 460 are provided. The user can select items 1 through 9, and when an item is selected, information may be selectively entered. For example, if the RV 30 was in Burlington, Iowa, the night before and now is in or near Sioux City, Iowa, the city item field 410 would be selected so as to modify this field 410. The user selects item "1".

In FIG. 5, the city menu 500 is now displayed. The user will select Sioux City 510, which will then be loaded by the microprocessor 200 into the target menu 400 with Sioux City's coordinates of longitude and latitude. This provides approximate latitude and longitude values to the receiver 60. This occurs in stage 350 as shown in FIG. 3.

Returning to FIG. 4, the system has already read the compass reading from the compass 80 and has entered in the compass heading or direction in field 450. Hence, the operator would select item 9"Search for Satellite" and stage 370 is entered.

It is to be understood that in stage 340, the operator could have referred to a map or other information to obtain a more precise longitude and latitude (such as a U.S. Geophysical map for the campground area). In this case the user would have selected items 2 and 3 in FIG. 4 to manually enter the longitude and latitude in stage 340. It is also to be expressly understood that the operator could override the compass by entering step 4. In this case, the operator could turn the compass off and manually read a compass so as to enter the heading in step 5. However, in normal operation, all that is required is for the user to select the nearest city, which in the above example is Sioux City. The city information is stored in the SRAM 204. The city list is a list of geographic locations that the system might be moved to, and each entry in this list contains a name, state code, corresponding location (latitude/longitude), and the magnetic declination associated with the location. In addition, the target menu 340 allows the operator to change the search characteristics: the initial predetermined satellite, the search channel, and the search frequency. This will be discussed subsequently.

Returning to FIG. 3, with the longitude and latitude for Sioux City entered in stage 360, the system automatically moves the antenna dish 10 searching for the predetermined satellite, for example, ANIK-E2. This searching process involves rough and fine tune searches in stage 370. If the predetermined satellite is not found, stage 380 is entered and a message is generated on the screen 72 that the target satellite could not be found, upon which stage 340 is entered and the process repeats. However, in the event the target satellite (ANIK-E2) is found, stage 390 is entered and the picture is displayed.

The operation of the system set forth in FIG. 3 requires only minimal operator input. In the typical case, simply selecting the nearest city from the city menu 500 in stage 350 is all that is required. From that point on, the system is fully automatic in aligning the satellite dish 10 to the target satellite 90. When the antenna 10 is aligned with the target satellite 90, the positions of the other satellites in the Clarke belt can be automatically calculated.

The menus shown in FIGS. 4 and 5 are those of the preferred embodiment. It is to be expressly understood that variations could be made thereto. For example, a digitized map could be shown as a menu and the location could be suitably chosen using a mouse control or the like.

In summary, the automated method of the present invention (1) generates a magnetic direction signal from a magnetic compass mounted on the satellite dish antenna, (2) stores a plurality of latitude and longitude coordinates correlated to a plurality of geographical locations, (3) displays in the TV 70 the geographic locations so that the user can select one, and (4) determines an initial search position based on the magnetic direction signal and the selected latitude and longitude coordinate.

4. Audio Subcarrier Search

An important feature of the present invention is the ability of the system to search for a specific audio subcarrier located in the target satellite. FIG. 6 shows a list of potential target satellites that could constitute the target satellite of the initial search. For each potential target satellite, a particular or predetermined channel has been selected and for that channel a unique subcarrier audio frequency is chosen. In scanning the list of FIG. 6, it is noted that each audio subcarrier frequency is uniquely different from the adjacent satellite's selected subcarrier frequency. For example, for ANIK-E2, channel 6 has a selected audio frequency of 5410 KHz, which is different from the adjacent GALAXY satellite channel 13 subcarrier frequency of 5760 KHz. Under the teachings of the present invention and in the preferred embodiment, channel 6 of ANIK-E2 having a subcarrier frequency of 5410 KHz represents a unique searching audio frequency of strong signal strength. The goal is to avoid using frequencies that are common to the same channels of adjacent satellites, such as 6800 KHz.

As shown in FIG. 6, menu 600 is displayed on TV 70 and the user at any time can select another satellite as the target satellite for the initial search by simply selecting a field such as 610.

Under the teachings of the present invention, the selected audio subcarrier is unique. That is, the frequency of the selected audio subcarrier is not present in the corresponding channel of any satellites near the target satellite.

In the preferred embodiment, the search menu of FIG. 6 is the list that contains the information necessary for the system to perform the search for the target satellite by looking for a predetermined subcarrier audio frequency at a predetermined channel or transponder location. This search characteristic list is stored in the SRAM 204. Use of the system of the present invention is as simple as entering the approximate latitude and longitude. Once these have been established, the search routine of FIG. 3 finds the target satellite. Upon locating the target satellite, the system accurately locates the positions of all the remaining satellites in the Clarke belt. In typical operating time, the operation of FIG. 3 is accomplished in as few as two or three minutes. The present invention greatly simplifies the process of locating each satellite and minimizes the knowledge requirements of the user who, under prior approaches, had to watch the television for a passing image.

Under the teachings of the present invention, the target satellite can be located accurately by selecting a unique subcarrier audio frequency. For example, all satellites have a 6.8 MHz audio subcarrier frequency. The selection of this audio frequency would be inappropriate since upon its detection, the actual identity of the satellite would not be known. However, selecting 5.41 MHz in channel 6 of the satellite ANIK-E2 would be appropriate, since no other satellite adjacent to ANIK-E2 has a 5.41 MHz audio subcarrier frequency. Hence, this is an important part of the present invention in that the targeted audio subcarrier frequency is uniquely different from the audio subcarrier frequencies of the adjacent satellites. This is also to be contrasted with most conventional prior art approaches that look for video frequencies. All video center frequencies look alike from satellite to satellite and therefore, it is impossible to determine which satellite has been detected and to which satellite the system is tuned. Hence, these prior art systems require that the operator visually identify the satellite by watching the received signal. This requirement is obviated under the teachings of the present invention.

5. Searching for the Target Satellite

Figure 7:
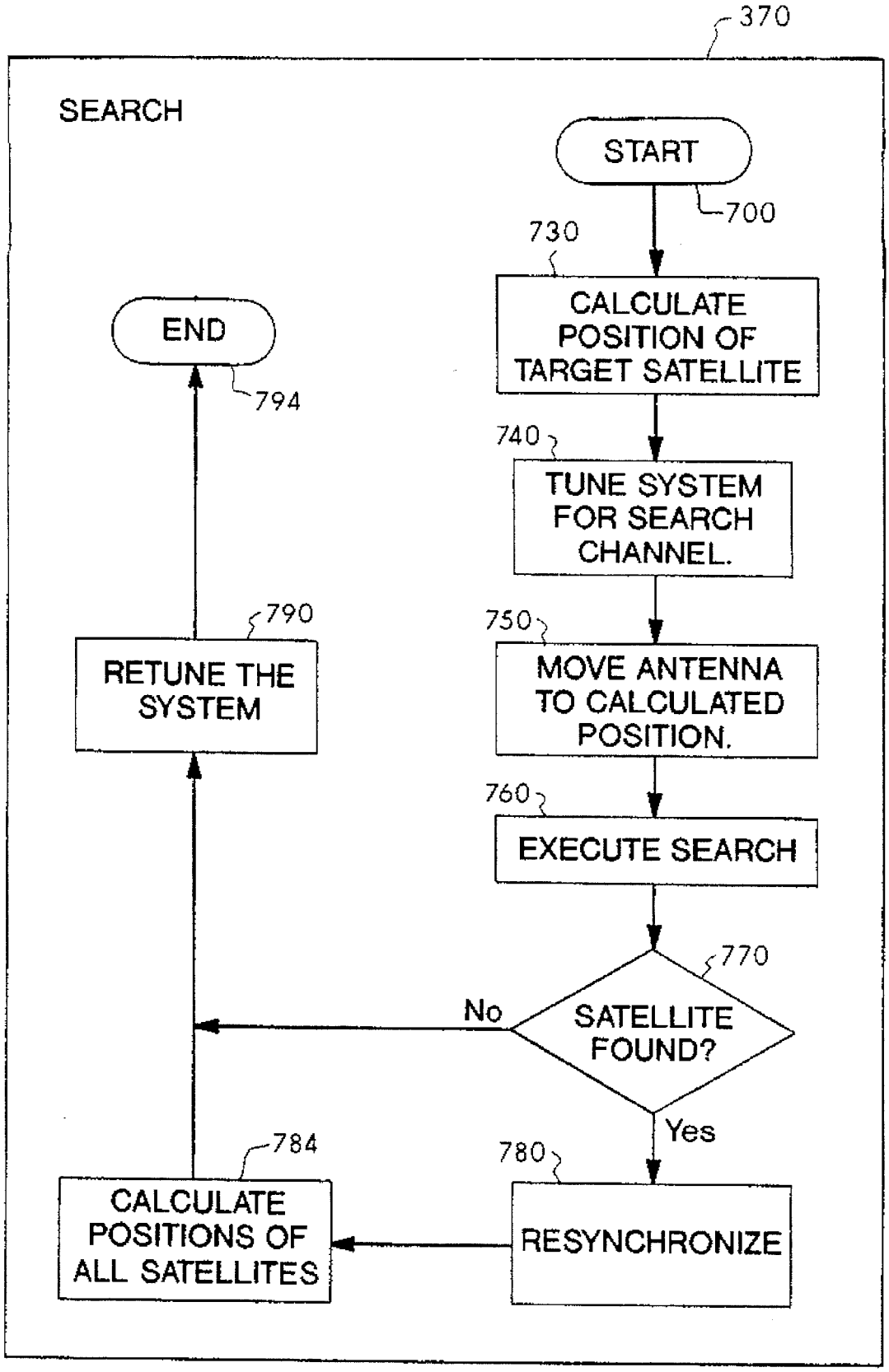
FIG. 7 sets forth the search flow chart for the overall operation of the system.
Figure 8:
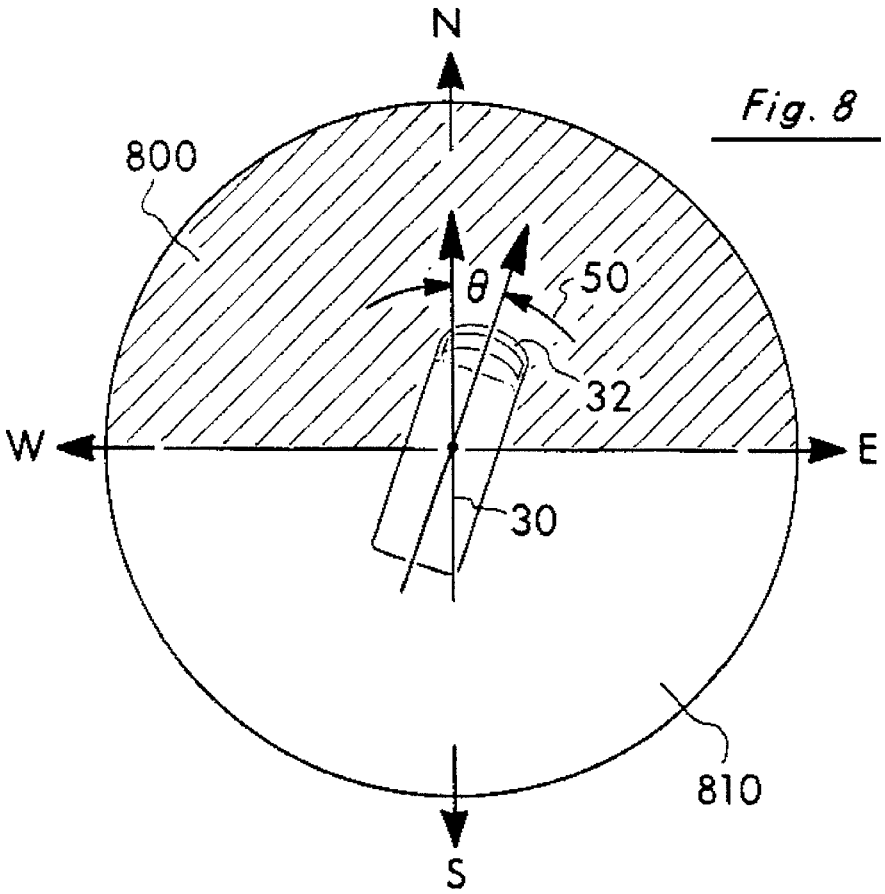
FIG. 8 is an illustration showing the orientation of a recreational vehicle oriented in the northerly direction.

In FIG. 7, the method of searching for the target satellite implemented by the receiver 60 in cooperation with the dish antenna 10 is shown. FIG. 7 sets forth the detailed steps for the search stage 370 of FIG. 3. Stage 370 is entered at 700. As shown in FIG. 8, the RV 30 may be oriented with the front 32 of the RV 30 pointed in the northern hemisphere 800. If the front 32 of the RV 30 is pointed in the southern hemisphere 810, then the reading from the electronic compass 80 delivered over line 68 into the receiver 60 causes the microprocessor 200 to adjust the following calculations by 180°. If the RV 30 is pointed in the northern hemisphere 800, then stage 730 is entered. If the RV 30 is pointed in the southern hemisphere, then stage 730 is entered with the calculation adjusted by 180°.

In stage 730, the microprocessor 200 calculates the initial search position of the target satellite 90.

6. Calculation of Target Satellite Initial Search Position

The satellite dish antenna 10 is first moved to an approximate position of the target satellite based on the latitude, longitude, and magnetic declination corresponding to the city nearest to the location of the campsite (or, as manually entered by the operator). This approximate position is calculated as follows.

Figure 10:
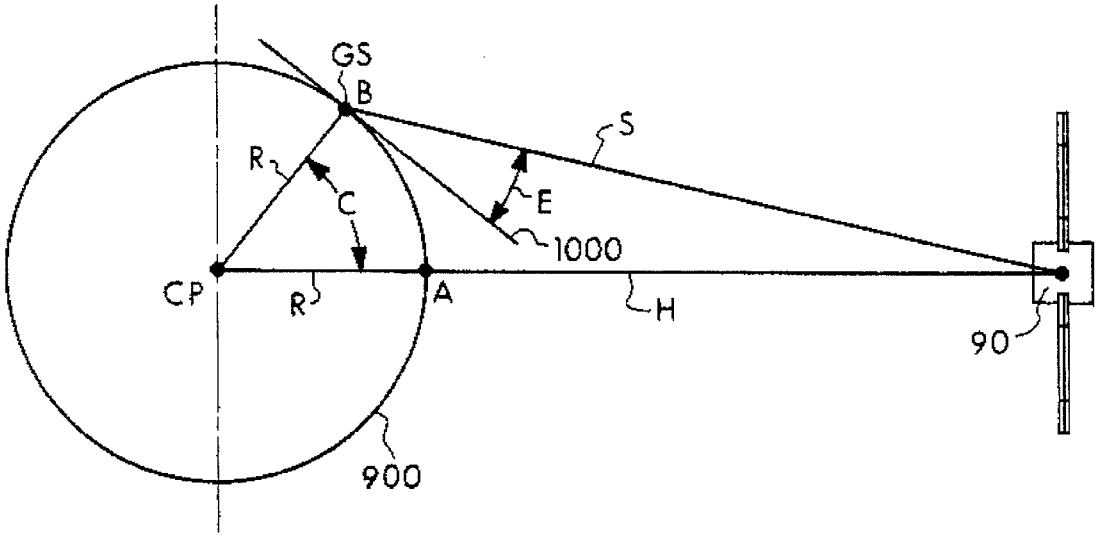
FIG. 10 is a side view representation of FIG. 9.
Figure 9:
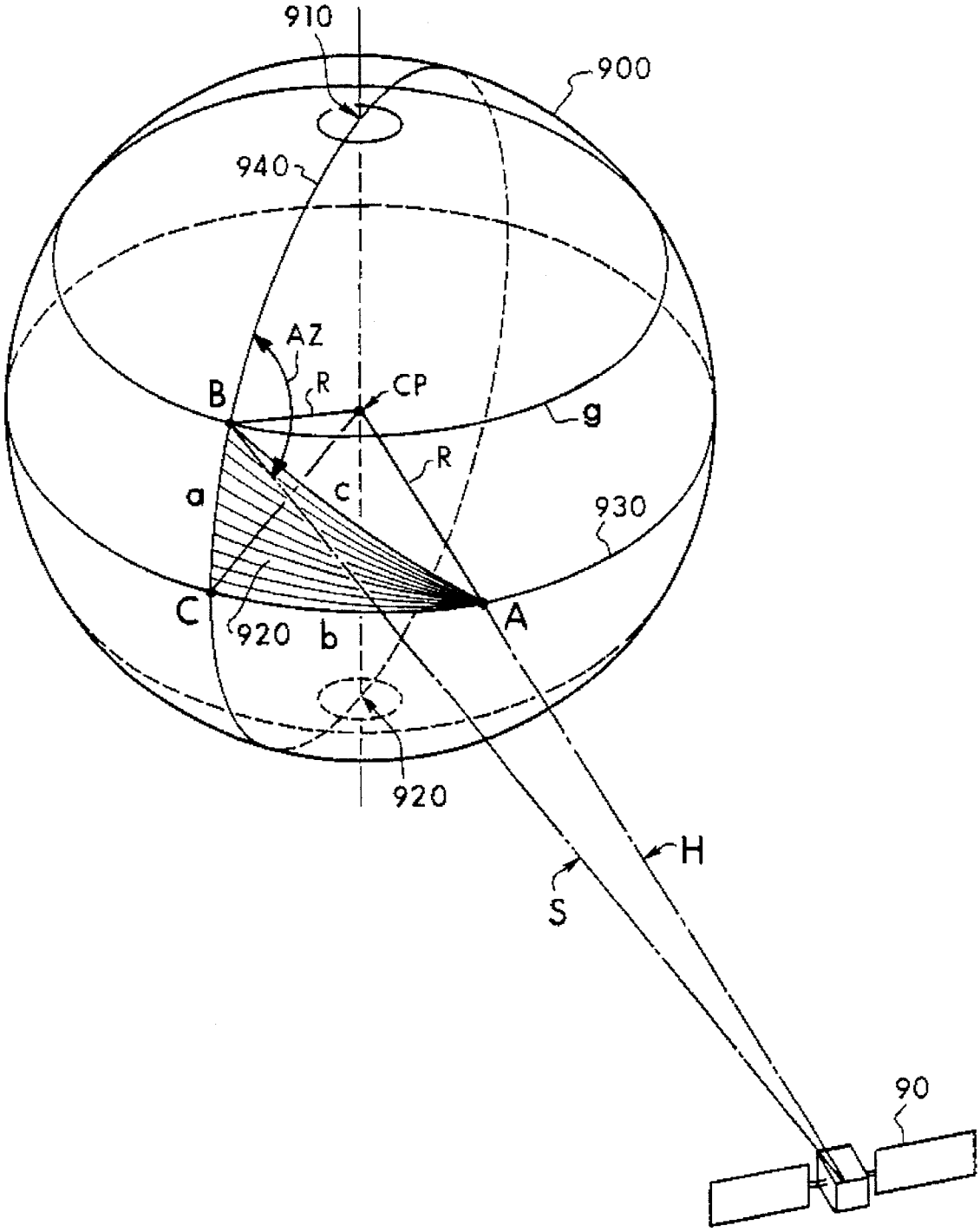
FIG. 9 sets forth a geometric relationship of a satellite with respect to the location of the recreational vehicle on the surface of the earth.

In FIGS. 9 and 10, the conventional TVRO-satellite geometry is set forth. In FIG. 9, the earth 900 is stylized having the North Pole located at 910 and the South Pole located at 920. The target satellite 90 is located in the Clarke belt, which is directly above the equator 930. The center point of the earth is at CP. Shaded area 920 represents a portion of the surface of the earth 900. Line segment AC having a length "b" is along the equator 930. Line segment BC having a length "a" is along a circular arc 940 that travels through point B, which is the location of the satellite dish antenna 10, to a corresponding latitude point C on the equator 930. Line segment AB having a length "c" is the distance between the satellite dish antenna 10 at point B and the satellite 90 at subpoint A on the equator 930. The target satellite 90 has an altitude H above the surface 900, which is the distance from A to the target satellite 90. Of course, point A is located a distance R from the center CP of the earth 900. Hence, the distance S from the target satellite 90 to the TVRO satellite dish 10 at point B is the slant range. The azimuth angle AZ is the angle between line S and the center line 940.

In FIG. 10, a different view of the geometry of FIG. 9 is presented. Here, the elevation angle E is shown as the angle between the tangent line 1000 with the earth 900 at point B and the slant range S.

Based on the TVRO satellite geometry set forth in FIGS. 9 and 10, which is conventional, the microprocessor 200 of the present invention is able in stage 730 to calculate the approximate position of the target satellite 90.

In the calculations set forth later, the following values are utilized:

B=location of the recreational vehicle or ground station (GS)

a=latitude of point B (positive in a northern hemisphere)

c=great circle arc from point B to point A g=longitude of point B (east is positive)

f=longitude of target satellite 90 (east is positive)

b=g-f

AZ=azimuth angle

E=elevation angle

S=slant range

H=altitude of satellite

R=radius of earth

It is to be understood that the values of f, H, and R are all fixed for the target satellite and are stored in the EPROM 206 of the receiver 60.

7. Calculation of Approximate Elevation Angle

The calculation of the approximate elevation angle E is:

$$E = \cos^{-1}\left[\frac{s^2 + R^2 - (R+H)^2}{2RS}\right] - 90 \quad (1)$$

where:

$$S = \sqrt{R^2 + (R+H)^2 - 2R(R+H) * \cos c} \quad (2)$$

$$\cos c = \cos a * \cos b \quad (3)$$

where:

These calculations provide the true elevation angle E. This must be transformed to the motor-driven mount for moving the antenna 10 in the elevation direction. The following calculations are based on the antenna mount set forth in the above-identified related invention. It is to be expressly understood that the teachings of the present invention are not limited to the precise mounting design of the related invention and that any suitable mechanical mount could be similarly transformed so as to be used under the teachings of the present invention. Hence, the following discussion of FIGS. 11*a* through 11*c* is for the preferred embodiment and is not meant to limit the teachings of the present invention in any fashion. The mount of the related invention has three pivot points, P1, P2, and P3. FIG. 11*a* shows the antenna 10 in the stowed position, FIG. 11*b* shows the antenna 10 unfolding, and FIG. 11*c* shows the antenna 10 tuned to the target satellite 90.

In FIG. 11*a*, pivot point P3 is fixed to the roof 20 of the RV 30. It is connected to pivot point P2 by means of a member 1110 having a length of R1. Pivot point P1 moves along line 1100 on the roof 20 a plus or minus distance. Line 1100 represents the direction of actual travel, hence, point P1 can move in plus or minus incremental steps along line 1100. Pivot point P1 is connected to pivot point P2 through a member 1120 having a length of R2. Point P3 is separated from line 1100 by a distance d. Member 1120 extends beyond point P2 and at 1130 undergoes an angle B with respect to member 1120 and forms a new member 1140 that connects to the antenna 10. Line 1150 is the antenna boresight of antenna 10. Line 1160 is the horizon line. As shown in FIG. 11*a*, elevation angle E is the angular relationship between the antenna boresight 1150 and the horizon 1160.

In the preferred embodiment, the following are the values for the mount of the related invention:

$E = -90° \leqq E \leqq 90°$

R1=5.526"

R2=5.066"

d=3.00"

B=−9.227°

$-1.000" \leqq x \leqq 11.000"$

As mentioned, FIG. 11*a* represents the antenna 10 in the stowed position with the boresight 1150 pointed at the roof 20.

In FIG. 11*b*, the receiver 60 activates the elevation motor 100 to move point P1 in the direction of arrow 1170. This causes point P2 to move upward in the direction of arrow 1172. At this point, point P1 is incrementally moving in the plus direction. The boresight 1150 of the antenna 10 is still below the horizon 1160. An important feature of the present invention pertains to the initial raising of the antenna 10 in the elevation direction. The software in the receiver 60 requires the antenna 10 to be lifted upward a predetermined height, Z, as shown in FIG. 11*b*, before any rotation in the azimuth direction takes place. This is necessary to prevent the antenna 10 from hitting nearby objects (such as air conditioning, vent pipes, etc.) on the roof 20 of the vehicle 30.

In FIG. 11*c*, the antenna 10 is pointed in the proper elevation direction of the target satellite 90. Based on the elevation transform model of FIG. 11, the value of x of can be calculated as follows:

$$x = R2 * \sin(E+B) + [R1^2 - (d - R2 * \cos(E+B))^2]^{1/2} \quad (4)$$

The value of x is the distance of movement required by actuator motor 100 to achieve the desired elevation angle E. This value would be the actual value required assuming the actuator actually coincided with line 100.

Figure 12:
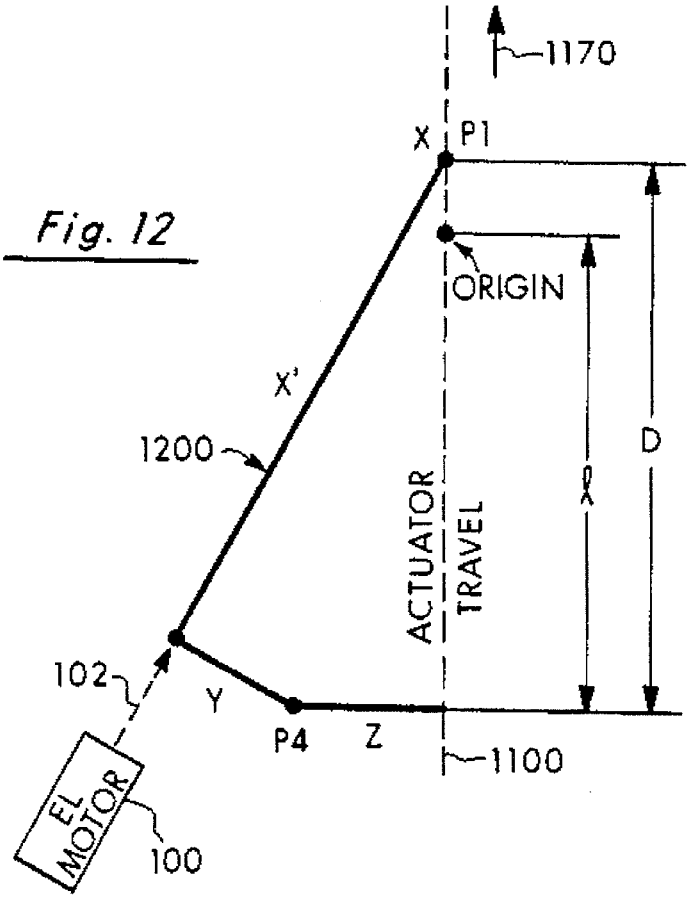
FIG. 12 sets forth the geometric relationship between the elevation motor and the mount of the present invention.

However, in the preferred embodiment, the actuator is offset from line 1100 as shown in FIG. 12. In FIG. 12, the actuator travel line 100 of FIG. 11 is shown. Point P1 slides along that line in the direction of arrow 1170. In FIG. 12 the following dimensions are based upon the mount of the related invention:

z=distance from line 1100 to pivot point P4=4.500"

y=distance from pivot point P4 to the center line of the actuator 1200=1.125"

D=the stowed dimension=27.785"

x'=the distance that the actuator moves

I=the length from line z to the ORIGIN=26.785"

$x_{min}$=the minimum×distance=−1.000"

D=1−x $C_{el}=(x'_{max}-x')pt$=number of counts for elevation t=lead screw pitch for the actuator in turns per inch (TPI)

p=pulse edges per revolution $x'_{max}$=maximum length of actuator=28.125"

The values of t and p for a particular actuator 1200 are constant. The pulse edges per revolution p are based on an optical interrupt approach detecting the edges per revolution. The geometric relationship in FIG. 12 simply provides the offset relation of x to x'. Hence, x'is related to x:

$$x' = [(D + x_{min} - x)^2 + z^2 - y^2]^{1/2} \quad (5)$$

Hence, the actual number of counts necessary to achieve a certain amount of elevation angle E for a particular actuator has been calculated. The computer upon performing the above calculations commands the elevation motor 100 through the latch 213 to activate the actuator by a certain number of counts $C_{el}$ over the mechanical interconnection 102, as shown in FIG. 12. The antenna 10 is thus moved to the elevation initial search position.

8. Determining Azimuth Increments

Returning to FIGS. 9 and 10, the azimuth calculations are determined as follows:

$$AZ = \tan^{-1}\left[\frac{\tan b}{\sin a}\right] + 180 \quad (6)$$

Figure 13:
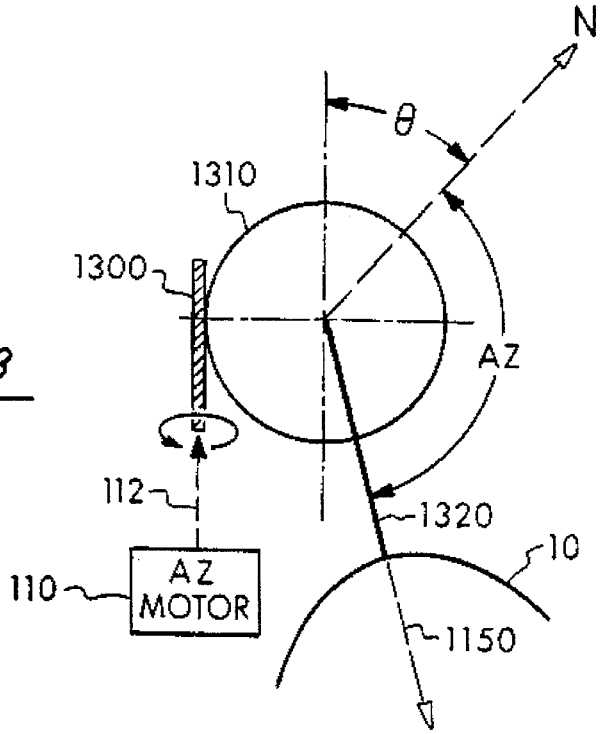
FIG. 13 sets forth the geometric relationship between the azimuth motor and the mount of the present invention.

In the preferred embodiment of FIG. 13, the worm gear 1300 engages a ring gear 1310. The antenna dish 10 is mounted on the ring gear 1310 by member 1320. Hence, the azimuth (AZ) can be adjusted based on the following formula:

$$C_{az} = \frac{NP(AZ - \Theta)}{360°} \quad (7)$$

The following values are used in the above formula:

N=number of teeth on the ring gear 1310

P1=pulse edges per revolution of the worm gear 1300

θ=compass setting: $-90° \leqq 0 \leqq 90°$, −90° is east, +90° is west $C_{az}$=the counts necessary for the azimuth motor 110 to rotate the worm gear 1300 through the mechanical linkage 112 to achieve the desired azimuth of the target satellite 90.

Again, the precise embodiment shown in FIG. 13 corresponds to the mount set forth in the related invention. It is to be expressly understood that any other mechanical apparatus adjusting the antenna 10 in the azimuth direction could be likewise mathematically transformed under the teachings of the present invention and that the present invention is not limited to the precise disclosure of FIG. 13.

Returning back to FIG. 7, at this point stage 730 is completed. The antenna 10 at this time is approximately positioned, under control of receiver 60, to the target satellite 90.

Stage 740 is then entered. In stage 740, the receiver 60 is tuned for a selected audio frequency of the target satellite 90, which in the target menu 400 of FIG. 4 is ANIK-E2, channel 6, audio subcarrier frequency 5.41 MHz.

In stage 750 the antenna 10 is now physically moved to the calculated azimuth initial search position of stage 730. Once the antenna 10 is in the initial search position, stage 760 is entered and the search now commences for the selected audio frequency in the selected channel of the target satellite 90.

9. Rough-Tune Search Pattern

Figure 15:
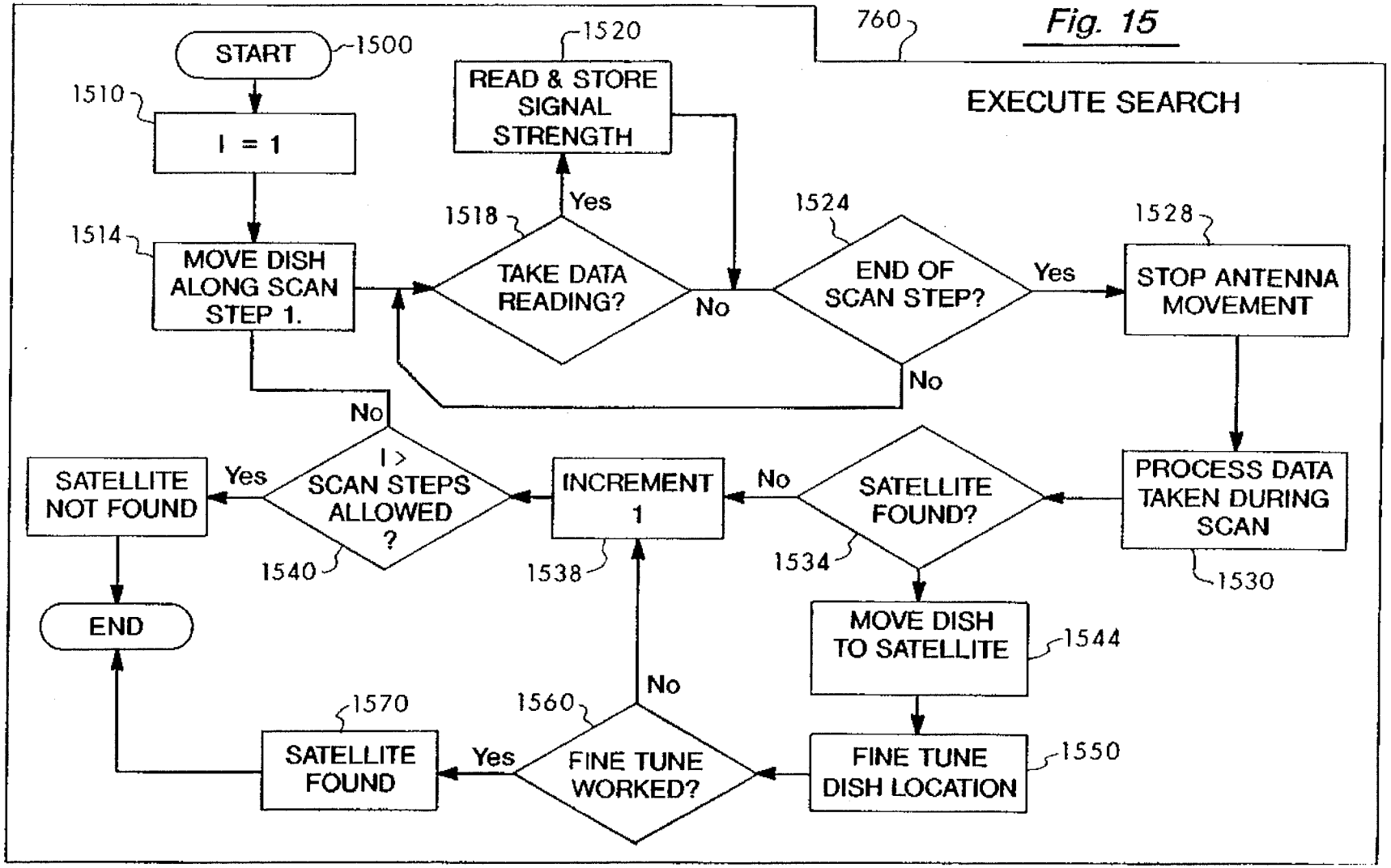
FIG. 15 sets forth the flow chart for the execute search.

FIG. 15 illustrates the steps taken by the present invention to conduct the rough-tune for the selected audio frequency of the selected channel. The execute search stage 760 is entered at the start 1500. At stage 1510, the initial scan step of I is set to 1. Stage 1514 is then entered. At this point, reference to FIG. 14 is important. In FIG. 14, the antenna 10 has its antenna boresighted at an initial calculated position that in FIG. 14 is referenced as J. The value of J was calculated in stage 730 and is the position of the azimuth and elevation motors.

The rectangular spiral search pattern shown in FIG. 14 for the rough-tune incrementally moves to the right in the u direction, then incrementally moves downward in the perpendicular v direction, then to the left in the 2u direction, then upward in the 2v direction, etc. This provides an ever-expanding spiral search pattern. The rough-tune search pattern moves the antenna 10 in a first linear direction, which could be either the azimuth or elevation direction, a given amount, u. The antenna 10 is then moved in a second linear direction that is perpendicular to the first linear direction a second given amount, v. In the preferred embodiment, the antenna 10 is then moved in the direction opposite the first linear direction by an amount equal to twice the first given amount or 2u. It is to be understood that "u" could be increased by any suitable constant value, which in FIG. 14 is by the amount of "u." The antenna is then moved in the direction opposite the second linear direction by an amount equal to twice the second given amount or 2v. It is to be understood that "v" could be increased by any suitable constant value, which in FIG. 14 is by the amount of "v."

Returning now to stage 1514 of FIG. 15, the boresight of the antenna 10 is initially moved from point J along the u direction for a first scan step of I=1. During this movement, a predetermined number of readings such as twelve are taken. During the u movement, in stage 1518, these twelve discrete readings are taken by the receiver 60. It is important to remember that the receiver 60 is tuned in to receive a precise subcarrier audio frequency. The twelve readings are taken at evenly spaced intervals during the "u" movement. In stage 1520 the readings are stored as to the signal strength detected. The processor 200 stores this information in the SRAM 204. Stage 1524 is then entered to ascertain whether the 12 readings have been taken. If twelve readings have been taken, then stage 1528 is entered. The antenna 10 is then stopped at point 1400. Stage 1530 is entered and the twelve readings taken during stage 1518 are processed.

Figure 16:
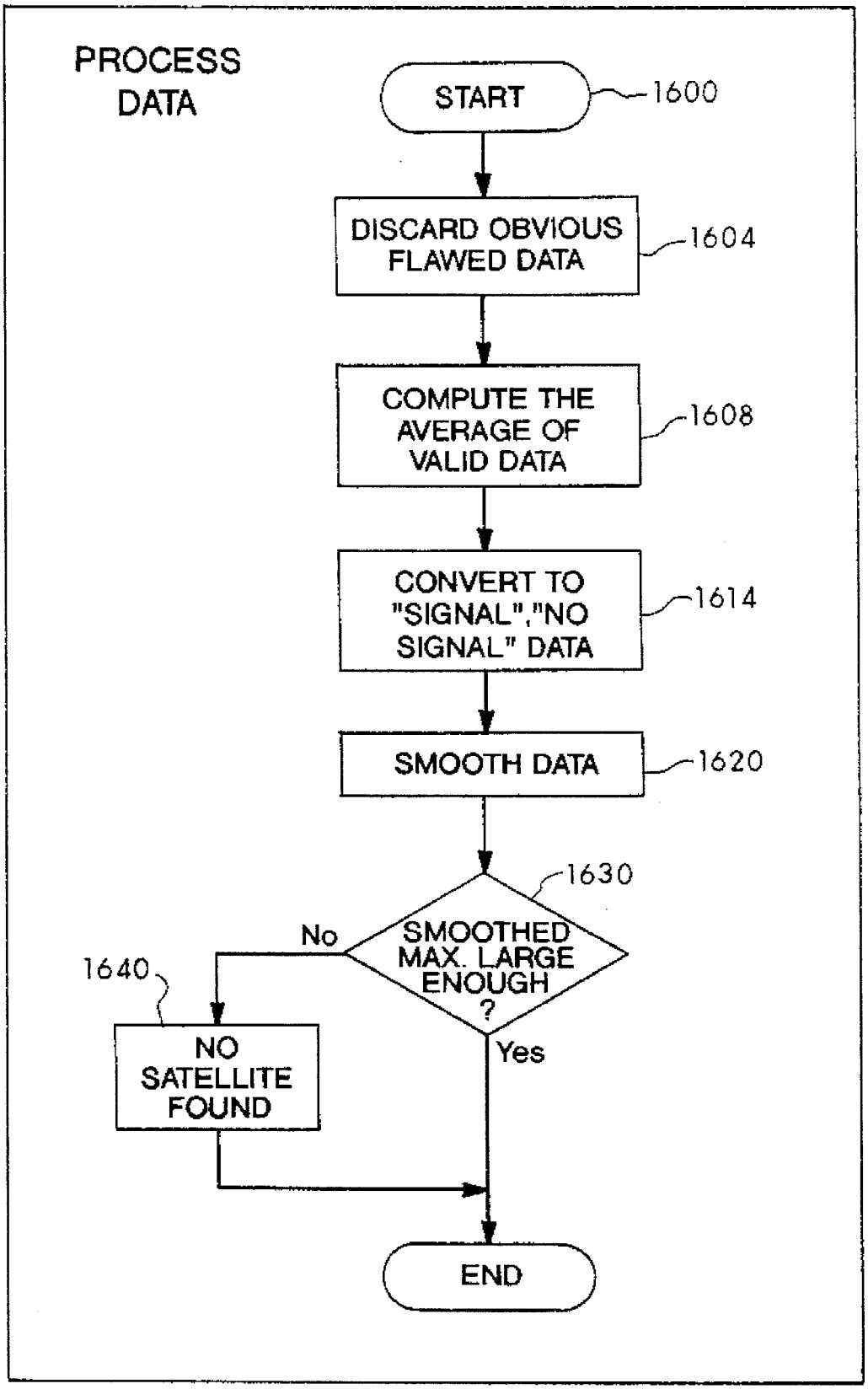
FIG. 16 sets forth a flowchart for processing data.

FIG. 16 sets forth the details of the process data step 1530. This stage is entered in the start 1600, and the first stage 1604 utilizes a statistical program to discard obvious flawed data. In the preferred embodiment, the ADC 214 of FIG. 2 may not operate fast enough thereby generating "zero" readings. This data, when sampled, is obviously flawed and is discarded.

Figure 20A:
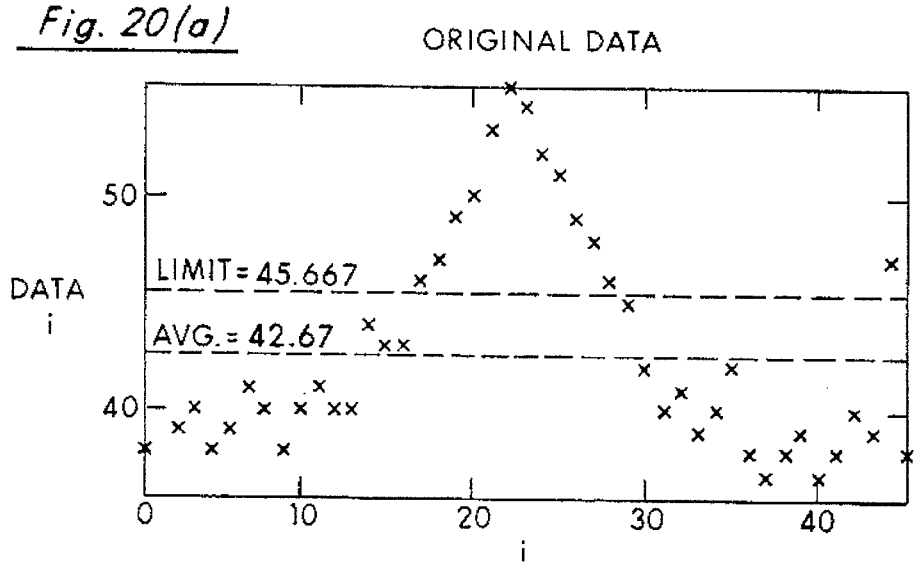
FIGS. 20(*a*)–(*c*) illustrate the detection of a valid peak "signal."
Figure 20B:
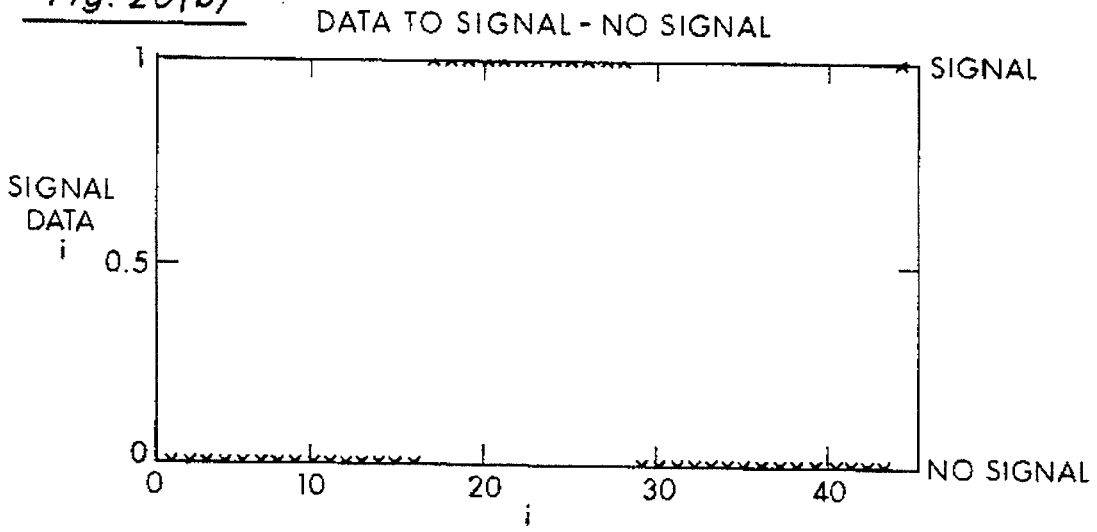
Figure 20C:
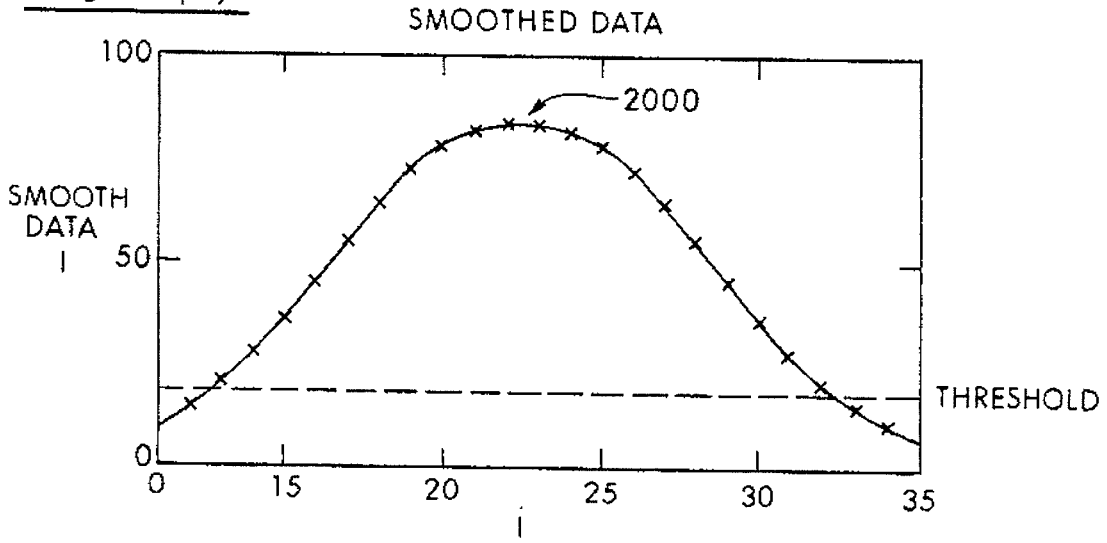

Stage 1608 is then entered, which computes the average of the remaining valid data. FIG. 20 sets forth an example of data illustrating a satellite that will be found, whereas FIGS. 21(*a*)–(*c*) set forth an example of data illustrating a situation in which a satellite will not be found. In FIGS. 20(*a*) and 21(*a*), the original data without the flawed data is shown. The horizontal axis sets forth the reading, i, and the vertical axis sets forth the signal strength. In stage 1608, the average is calculated, which for FIG. 20(*a*) is 42.67, and for FIG. 21(*a*) is 40.6. In stage 1614, the signal is converted to a "signal" or "no signal" value. This is represented in FIGS. 20(*b*) and 21(*b*). The signal data is recorded as a "signal" or "no signal" (i.e., either a 0 or a 1) based on whether the individual signal data is above the determined average. In the preferred embodiment, a level of "3.0" is utilized so that the limit is 3.0 above the average. In the case of FIG. 20, the average is 42.667. Adding 3 to this results in a limit of 45.67. Hence, all data points above 45.667 become a "1" or a signal and all values below the limit become a "0" or no signal as shown in FIG. 20(*b*). The same is true of FIG. 21(*b*).

Stage 1620 is then entered and the data is smoothed. This is shown in FIGS. 20(*c*) and 21(*c*). The data that is smoothed is a collection of 1's and 0's as previously discussed. The weight of each data point upon its neighbors is determined by its distance from its neighbors. Points that are further away than the range are considered to have no effect.

Figure 21A:
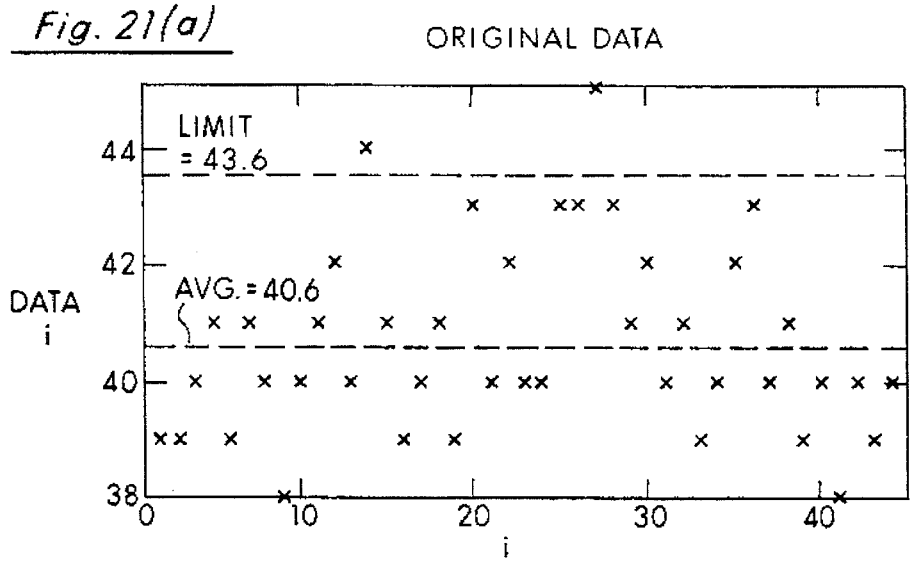
FIGS. 21(*a*)–(*c*) illustrate the detection of "no signal."
Figure 21B:
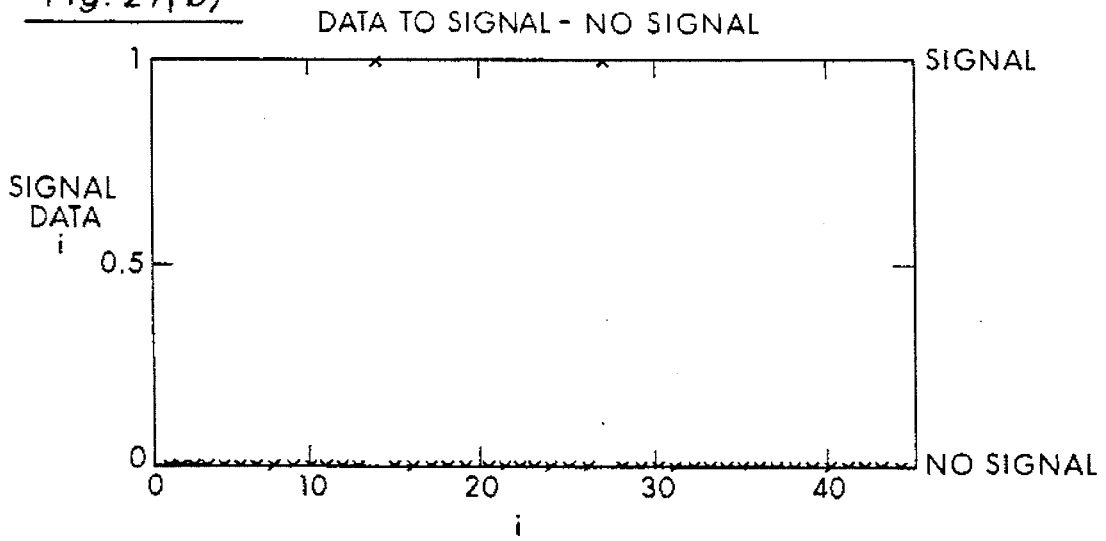
Figure 21C:
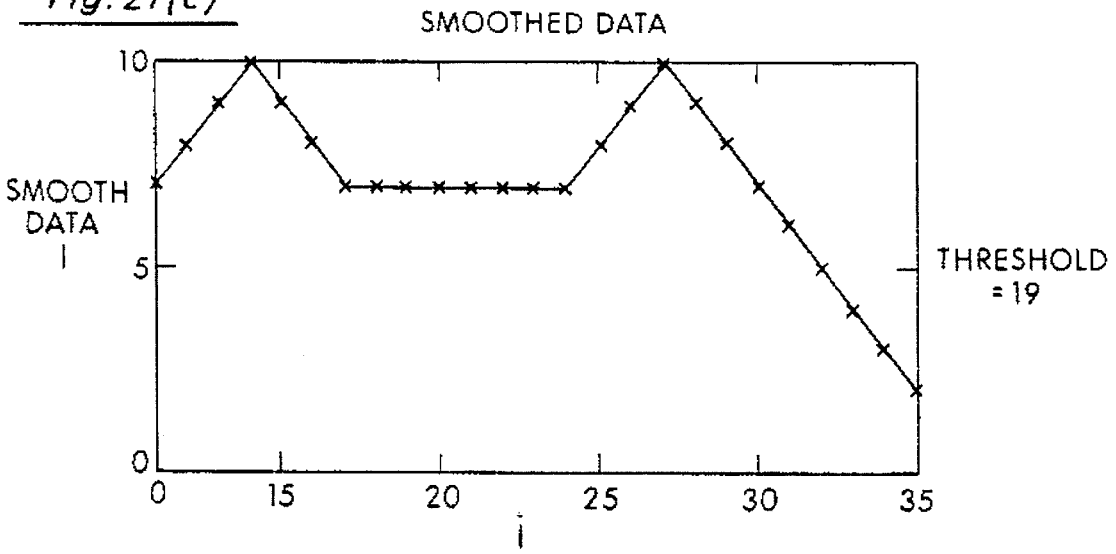

Hence, in FIG. 20(*c*) and 21(*c*), the smooth data appears for each example. In FIG. 20(*c*), the peak is found at 2000. The threshold of 19 is also shown in FIG. 20(*c*). The peak 2000 represents the position of a found satellite. In FIG. 21(*c*), the threshold is also 19 and two peaks are found, indicating that the satellite cannot be located.

Stage 1630 is then entered. A determination is made as to whether the smoothed maximum peak is large enough. If not, stage 1640 is entered and the process data stage 1530 is ended. On the other hand, if the smooth maximum is large enough, then the process stage is ended successfully.

With reference back to FIG. 15, stage 1534 is then entered to ascertain whether the target satellite has been found. If the target satellite has not been found, then stage 1538 is entered which causes the increment for the scan step to increase by an increment of 1. In stage 1540 a question is asked whether the permitted number of scan steps for I has been exceeded. If not, stage 1514 is reentered, and during this scan, the spiral search pattern now moves a distance v toward point 1410. Again, twelve readings are taken, and the antenna is stopped at point 1410 in stage 1528. Twelve is a convenient number, and any number could be used since this is based on the availability of memory in the SRAM 204. Again, the data is processed, and if the satellite is not found in stage 1534, the search pattern continues from point 1410 to point 1420 for a distance of 2u.

Assume with respect to FIG. 14 that at point K corresponding to the tenth data reading in scan step I=3, a maximum peak is detected in stage 1630 by the process data stage 1530, thereby indicating that the target satellite is found. The system then moves from stage 1534 to stage 1544, which causes the satellite dish antenna 10 to move its boresight to correspond to point K. Stage 1550 is then entered. This is the fine-tune stage of the present invention.

As can be seen in FIG. 14, the boresight of the antenna was initially positioned to point at J based on calculations using the entered longitude and latitude as well as the measured compass reading. The rough-tune search automatically seeks the boresight position giving the best signal for the selected sub-carrier audio frequency, which as shown in FIG. 14 is at point K for purposes of illustration. It is to be expressly understood that the teachings of the present invention are not limited to a spiral search pattern and that other search patterns could be used.

10. Fine-Tune Search Pattern

In FIG. 17, the method used for fine-tuning is illustrated. The bore-sight of the antenna 10 is roughly tuned to point K in FIG. 17. K forms the center of a rectangular window 1700 that has a dimension of 2n (width) by 2m (length). K is located in the center of the rectangle 1700. The width of the window could be either the azimuth or the elevation direction.

FIG. 18 sets forth the details of the fine-tune stage 1550. This stage is entered at start 1800 and then the first stage 1804 is entered. The antenna 10 is directed to align the boresight at point D1, which is on the edge of the window 1700. The antenna is scanned along a first line from D1 through K to D2, which is the opposing edge of the formed window 1700. This occurs in stage 1808. One hundred data readings are taken between D1 and D2, which is determined by stage 1810. This is a significant increase in the taking of data samples compared to the rough-tune. The scanning continues until the edge of the window D2 is reached in stage 1814. Each data reading is read and stored in stage 1818. When 100 readings are taken, stage 1820 is entered. The antenna movement is stopped.

Stage 1530, which is illustrated in FIG. 16, is reentered. If no satellite is found in stage 1824, stage 1828 is entered, which causes the antenna 10 to move back to point K. Stage 1830 is then entered, indicating that the fine-tuning has failed.

However, if the target satellite is found, stage 1840 is entered. Assume, for purposes of illustration, that the detected peak is located at point L. The boresight of the satellite dish antenna 10 is moved to point L on line D1-D2 in stage 1840. The boresight of the antenna 10 is then moved to E 1 in stage 1844. The boresight of the antenna 10 is then scanned on line El-E2, which is perpendicular to line D1-D2. This occurs in stage 1850. One hundred samples are taken as the antenna moves from point E 1 to point E2. In stage 1854 the readings taken are stored in stage 1858 until the opposing edge E2 of the window is detected in stage 1860.

Again, the antenna is stopped in stage 1864 and stage 1530 is reentered to ascertain the peak. If the peak is not found, then no satellite is found in stage 1870, causing the system to enter stage 1874,, which moves the antenna back to starting point K and then into stage 1878 indicating that the fine-tune failed. However, assume that a peak was located at point M. The boresight of the satellite dish antenna 10 is then moved so that it aligns with point M in stage 1876. Stage 1880 is entered indicating that the fine-tune has worked, and stage 1550 is exited. At this point, and with respect to FIG. 17, the precise location of the satellite has been obtained.

Returning to FIG. 15, stage 1550 is exited and stage 1560 is entered indicating that the fine-tune has worked. If the fine-tune has not worked, as indicated by stages 1830 and 1878 of FIG. 18, then stage 1538 is reentered. However, if the fine-tune works, then stage 1570 is entered and the satellite is found. The executed search 760 of FIG. 7 is now exited.

It is to be understood that while the spiral search is used for the rough tune and the rectangular search is used for the fine-tune, the system would still operate if the two were reversed in order or if two successive spiral searches or if two successive rectangular searches were used.

11. Resynchronize

Returning now to FIG. 7, stage 770 is entered. When the target satellite is found, stage 780 is entered. This is an important part of the present invention. Initially the system calculated the position of the target satellite in stage 730. This initial calculation assumed a physical zero position for $C_{az}$ and $C_{el}$. The term "physical zero" means that the system starts at a predetermined fixed count relative to the stowed position. However, as can be witnessed with respect to FIGS. 14 and 17, the calculated position J of the target satellite did not correlate to the final actual peaked position M. Hence, in stage 780, the initial physical zero values for $C_{az}$ and $C_{el}$ are updated by the microprocessor 200 so that the calculation occurring in stage 730 would now precisely calculate point M. This is an important feature since the user of the system can re-stow the antenna 10, and then, upon reinitiation of the system, the system will rapidly, in stage 730, fine-tune directly to the satellite. This is true if the RV 30 has not moved to a new position.

Stage 784 is then entered wherein the positions of all the remaining satellites are calculated. These calculations occur in the same fashion as the calculations in stage 730 occurred except for the relative location of the remaining satellites. Stage 790 is then entered wherein the receiver 60 tunes the system to the precise satellite and transponder selected by the user. In other words, the target satellite, although utilized to tune the satellite dish antenna 10 to the satellites in the Clarke belt, is transparent to the user of the system, who desires only to see the satellite and transponder that he has selected. Stage 794 is then entered and the search stage 370 is over with.

Returning to FIG. 3, the picture is displayed in stage 390. It is to be expressly understood that the TVRO system of the present invention could also be used at a fixed "at-home" installation.

12. Adjustment of Search Parameters

In FIG. 19, the user of the present invention has complete control over the search parameters for the rough-tune and fine-tune patterns as discussed above. FIG. 19 sets forth the search parameter menu displayed on the TV 70. The menu controls all the operational parameters.

For example, for the rough-tune, in FIG. 19, the azimuth portion of the spiral corresponds to 60 counts and the elevation portion of the spiral corresponds to 90 counts. One degree in the azimuth direction contains 10 counts. I=14, which corresponds to the scan steps. The number of data samples taken for each of the scan steps is set to 12. Any of these parameters can be suitably adjusted by the user within a range of values.

Likewise, the fine tune has set the azimuth fine counts equal to 50 and the elevation fine window counts equal to 75. Elevation direction is 15 counts per degree on average. The azimuth fine steps are 100 and the elevation fine steps are 150. Again, any suitable range could be selected by the user. Finally, the signal threshold is set to 3.

13. Polarity Adjustment

Figure 22:
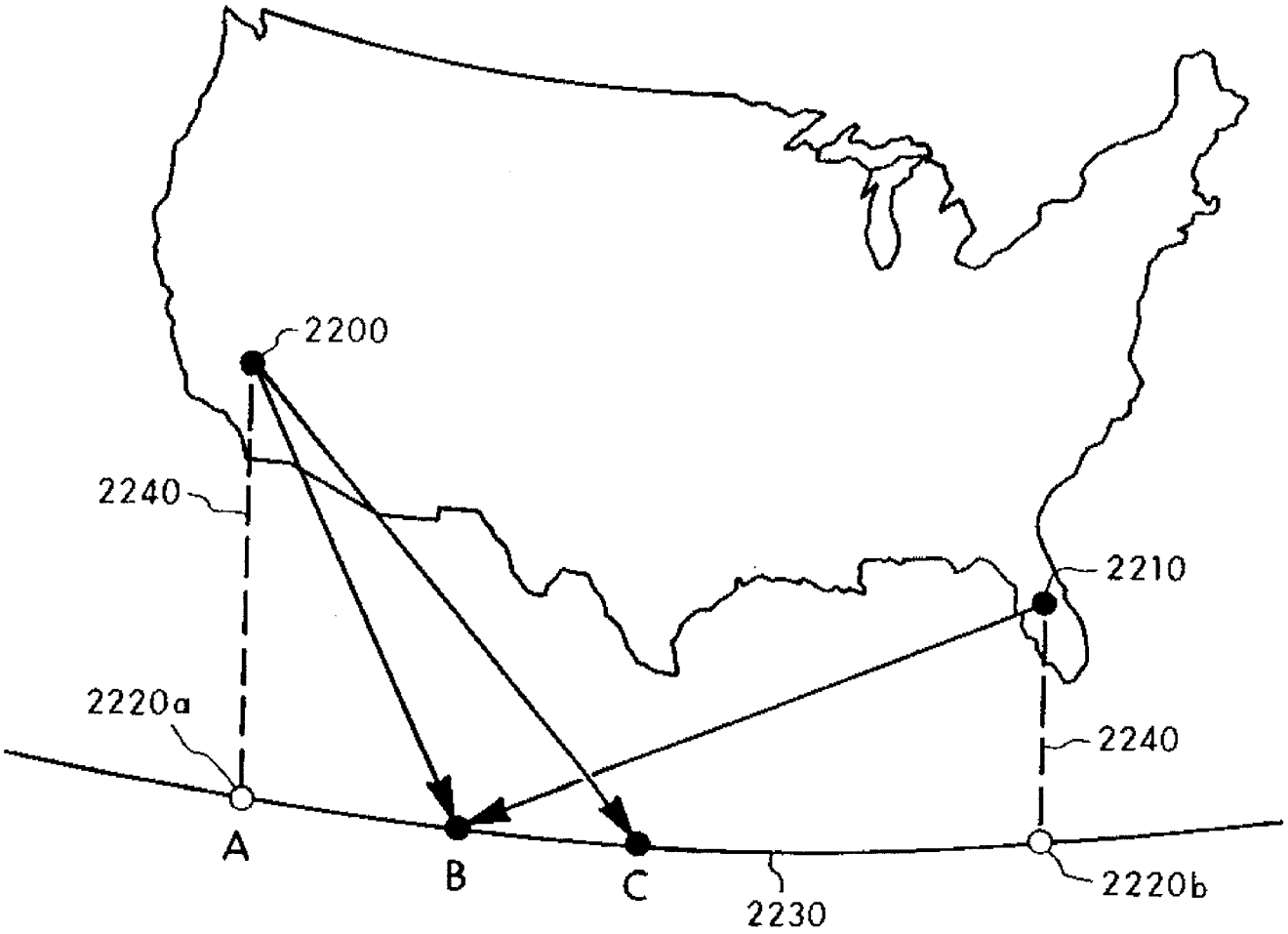
FIG. 22 sets forth two possible locations of the antenna of the present invention requiring polarity adjustments.
Figure 23:
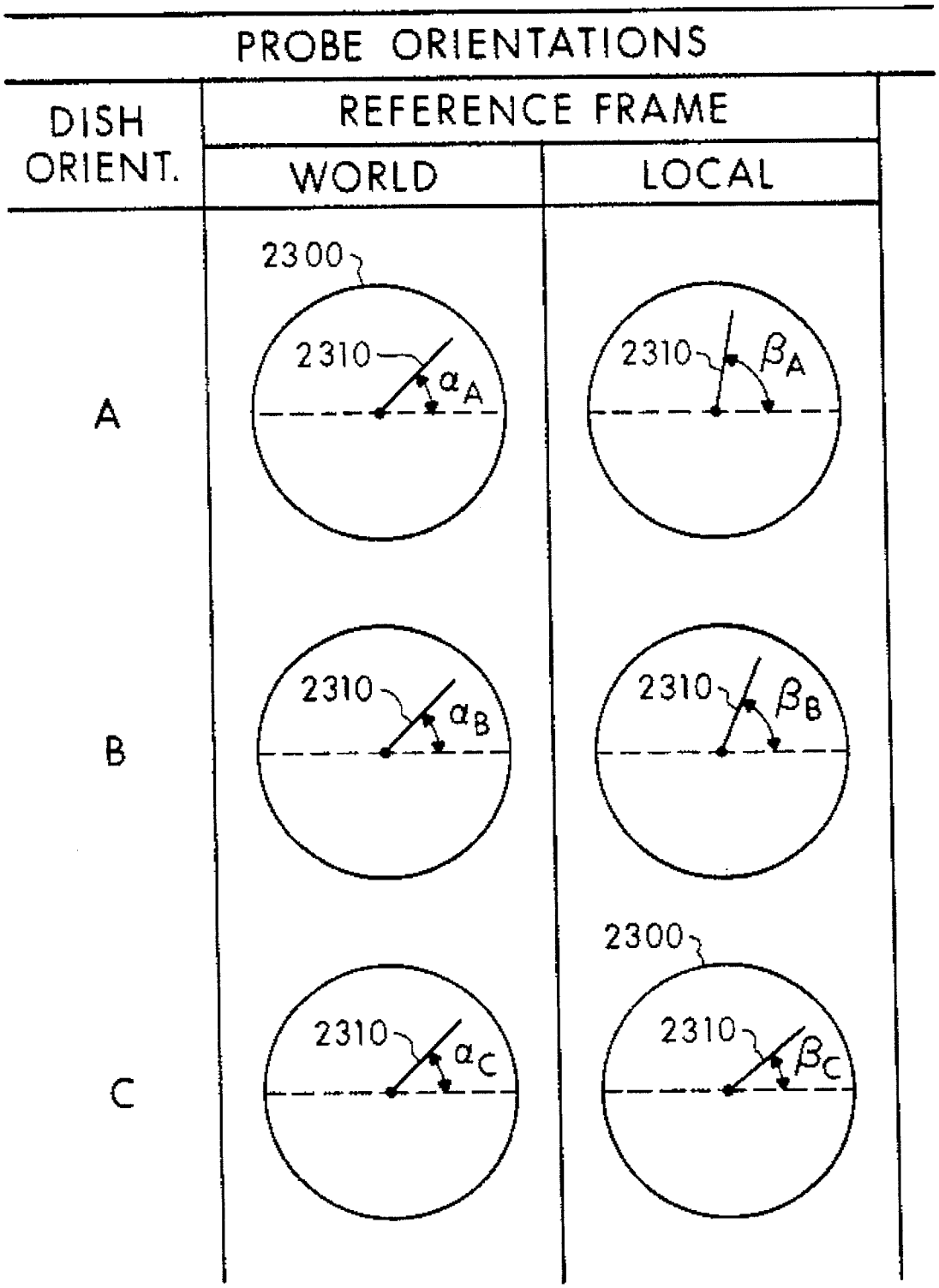
FIG. 23 illustrates the adjustment of the probe of the present invention for proper polarity.

As a final feature of the present invention, this receiver 60 is capable of automatically compensating for variations in the polarity settings. This is shown in FIGS. 22 and 23. As the vehicle 30 moves, for example, across the United States, the polarity setting of the polarotor probe from one location to the other location may vary. This would especially be true if the vehicle 30 would move from California 2200 to Florida 2210 which would represent the extremes. This represents an option that may be provided in the receiver 60 of the present invention. This may occur, for example, prior to entering search 370 and may be activated as a separate selection in menu 400 as shown as item 8 in FIG. 4. The polarity is adjusted so that when the search stage 370 is entered, a maximum audio signal will be detected. If the polarity is improperly adjusted, then the true peak signal will not be detected in either the rough-tune or fine-tune stage.

To compensate for the polarity setting, a reference satellite 2220 is assumed to exist in the Clarke belt 2230. The reference satellite 2220 is always assumed to be due south 2240 of the vehicle 30. Hence, the following two values of azimuth and elevation are true for the reference satellite:

$AZ_r$=180°

$EL_r$=a value to be calculated

As fully set forth in the foregoing sections of this application, the calculations of the azimuth and elevation angles for the target satellite have been determined. Hence, the target satellite has the azimuth (AZ) and the elevation (EL) angles. When the system performs the search it calculates the polarity for the target satellite based on the initial search position which ensures a successful search. After the search is completed, the polarities are then calculated for the other satellite locations.

To determine the rotation of the system from the reference satellite so as to determine the adjustment to the polarity, the following two calculations are used:

$$\Delta AZ = AZ_r - AZ = 180° - AZ$$

$$\Delta EL = EL_r - EL$$

$$\text{Total rotation} = T_r = \Delta AZ + \Delta EL$$

New polarity settings are set forth in the following two formulas:

$$P_v = P_{vr} + T_r$$

$$P_h = P_v + 90°$$

where:

$P_v$=new vertical polarity $P_{vr}$=reference vertical polarity $T_r$=total rotation $P_h$=new horizontal polarity The value of $P_{vr}$ is that angle that the system of the present invention would have for the vertical polarity of the target satellite if the system was placed at the same longitude as the target satellite. In the present embodiment, the reference value $P_{vr}$ is the same for all satellites in the Clarke belt and is 170°.

In FIG. 23, an example of calculating the probe 2310 orientation is set forth. Assume satellites A, B, and C are located in the Clarke belt 2230 of FIG. 22. Satellite A (i.e., 2220*a*) is the reference satellite and is due south of location 2200. Satellite B is east of satellite A and satellite C is east of satellite B. In FIG. 23, the dish antenna 2300 has a conventional polarotor probe 2310 that must be oriented to allow the antenna 2300 to receive signals of either horizontal or vertical polarity. In the chart of FIG. 23, the dish antenna 2300 is initially pointed at satellite A. The probe 2310 is oriented to match the vertical polarity $P_v$, which is $\alpha_A$. Under the teachings of the present invention, $\beta_A$ is used as the reference angle. As indicated above, the vertical polarity, $\alpha_A$ is always 170°. The horizontal polarity $P_h$, $\beta_A$, is calculated as set forth above. When the dish antenna 2300 is pointed at satellite B, the vertical polarities match so that $\alpha_A$ equals $\alpha_B$. However, the horizontal polarities $\beta_A$ and $\beta_b$ are not equal. Hence, and as set forth above, the difference is calculated as $\Delta\alpha = \beta_B - \beta_A$. When the dish antenna 2300 is pointed at satellite C, which is east of satellite B, again the vertical polarities match, so that $\alpha_{A=\alpha B=\alpha c}$. However, $\beta_A$, $\beta_B$, and $\beta_c$ are not equal. Hence, the difference, $\Delta\beta = \beta_{c-\beta A}$.

14. Two-Satellite System.

Figure 24:
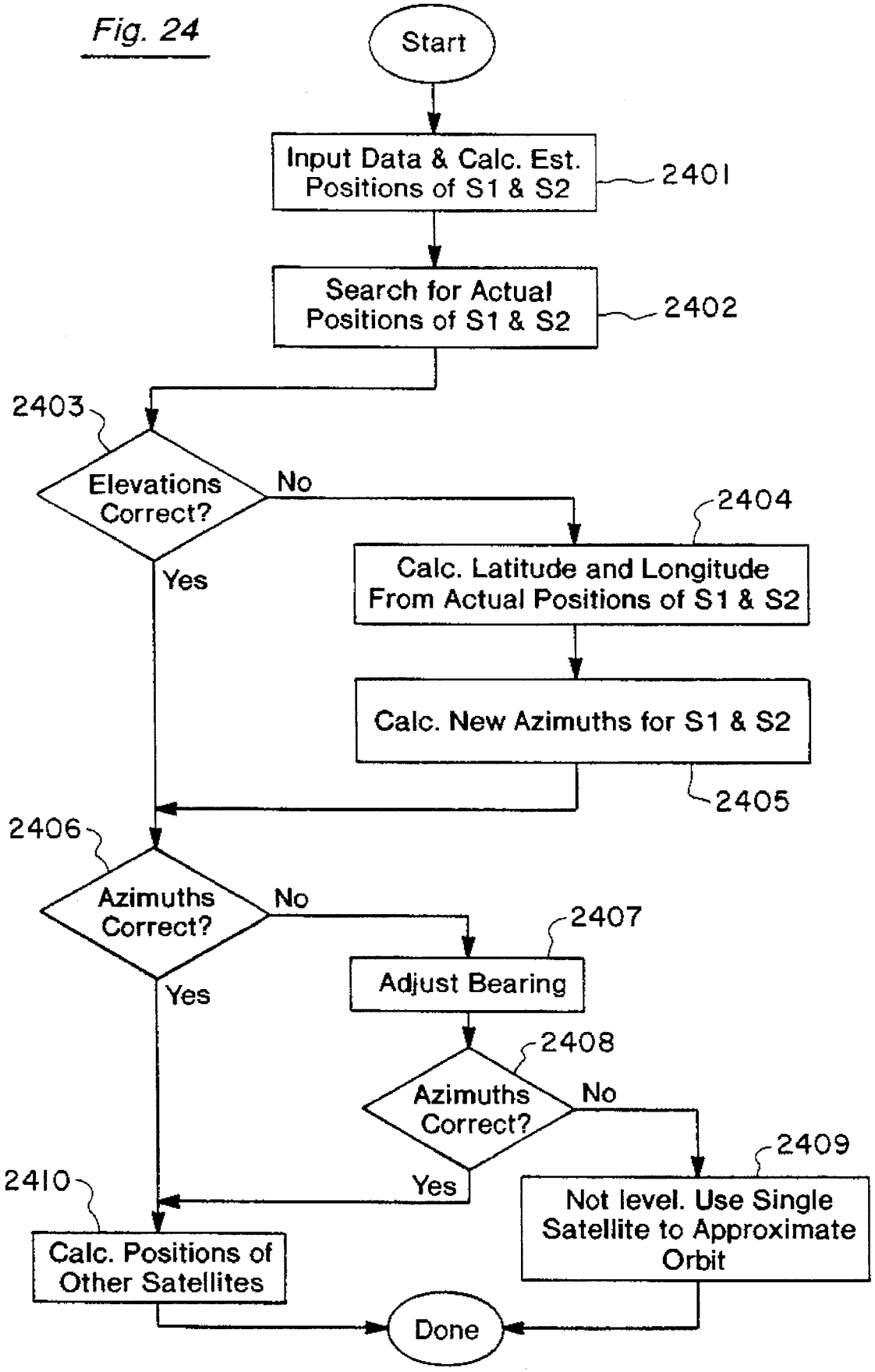
FIG. 24 is a flowchart for operation of an alternative embodiment in which the system automatically determines the location and bearing of the vehicle based on two geosynchronous satellites.

FIG. 24 provides a flowchart of an alternative method for determining the location and bearing of the antenna mount from two geosynchronous satellites. This procedure is based on knowing the orbital locations of two geosynchronous satellites, determining the azimuth and elevation of each satellite from the earth station location, and then calculating the latitude, longitude, and bearing of the earth station. Once these parameters are known, the azimuths and elevations of all other satellites can be calculated.

Three pieces of data are needed to determine the location and orientation of the vehicle 30 relative to the earth and satellites:

1. Bearing (direction to true north)
2. Location of the vehicle on the earth's surface (latitude and longitude of the satellite antenna mount)
3. Orientation of the mount to the earth's surface (leveling)

The mount is initially assumed to be level, since most large RV's have leveling devices. Leveling is usually the easiest adjustment to accomplish and the easiest for the user to judge accurately. Of the two remaining factors, true north is the most difficult to determine and the most sensitive variable in locating satellites.

In this embodiment, system operation begins as previously described in section 3 (System Operation). The user turns on the receiver 60 and the TV 70, and the system becomes initialized at stage 310 in FIG. 3. As before, the user is prompted by the target menu 400 and city menu 500 to designate an approximate location for the vehicle, which is then used to look up estimated longitude and latitude coordinates for the vehicle. The system obtains a compass reading from the compass 80 to provide an estimated bearing. The longitudes of the two geosynchonous satellites are known values that have been permanently stored in the system. Therefore, following initialization in stage 2401 of FIG. 24, the following data has either been entered or is known by the system:

$SLON_1$=longitude of satellite 1 (S1)

$SLON_2$=longitude of satellite 2 (S2)

ELON=estimated longitude of vehicle

ELAT=estimated latitude of vehicle

EBRG=estimated bearing of vehicle $AZ_1$=estimated azimuth of satellite 1

$AZ_2$=estimated azimuth of satellite 2

$EL_1$=estimated elevation of satellite 1

$EL_2$=estimated elevation of satellite 2

The estimated azimuth ($AZ_1$ and $AZ_2$) and elevation ($EL_1$ and $EL_2$) angles for both satellites are calculated from SLON, ELON, and ELAT as follows:

$$AZ = \tan^{-1}\left[\frac{\tan(ELON - SLON)}{\sin ELAT}\right] + 180 \quad (8)$$

$$EL = \cos^{-1}\left[\frac{S^2 + R^2 - (R+H)^2}{2RS}\right] - 90 \quad (9)$$

$$S = \sqrt{R^2 + (R+H)^2 + 2R(R+H)\cos C} \quad (10)$$

$$\cos C = \cos(ELAT) * \cos(ELON - SLON) \quad (11)$$

where:

R=radius of the earth=6367 km; and

H=height of the satellite about the earth=35800 km

At stage 2402, the system performs a search by incrementally moving the antenna 10 as outlined above in sections 8–10 and FIG. 4–21 to determine the actual position of the first satellite. The estimated azimuth and elevation for the first satellite ($AZ_1$ and $EL_1$) calculated in equations (8) and (9) serve as the starting direction for the search. A second search is performed to determine the actual position of the second satellite in the same manner from $AZ_2$ and $EL_2$. After the searchs are completed, the following data is known:

$az_1$=actual azimuth for satellite 1

$az^2$=actual azimuth for satellite 2

$el_1$=actual elevation for satellite 1

$el_2$=actual elevation for satellite 2

The procedure continues by determining whether the location, bearing, and leveling data is in error and, if possible, making the necessary corrections. To properly position the antenna to the correct azimuth angle requires knowledge of the bearing of the antenna mount (EBRG) relative to true north. To properly position the antenna 10 to the correct elevation angle requires that the antenna mount be level. The vehicle bearing (EBRG) is the more probable source of error, and leveling is the less probable source of error. This implies that the first test should be for correct elevation. Otherwise, if the first test were for correct azimuth, there is a significant probability that offsetting errors in location and heading could give a false-positive result.

At stage 2403, the system tests whether the estimated elevation angles of both satellites ($EL_1$ and $EL_2$) are within predetermined tolerances of the actual elevation angles ($el_1$ and $el_2$) found in the search procedures. If the estimated elevations of both satellites are equal to their actual elevations ($EL_1$=$el_1$and $EL_2$=$el_2$), then it is likely that the location is correct and the mount is level. If the estimated elevations of both satellites are not equal to their actual elevations ($EL_1 \neq el_1 \neq$or $EL_2 \neq el_2$), then either: (a) the location is incorrect and the mount is level; or (b) the location is correct and the mount is not level; or (c) the location is incorrect and the mount is not level. If case (a) exists, then the location and, if necessary, the bearing can be corrected with the available information. If case (b) or (c) exists, then it is indeterminate whether the location or leveling is in error. To determine whether case (a) exists, new location data for the mount (ELON and ELAT) is derived from $el_1$ and $el_2$ at stage 2404, as follows:

$$k_1 = \cos\left[\cos^{-1}\left(\frac{R\cos el_1}{R+H}\right) - el_1\right] \quad (12)$$

$$k_2 = \cos\left[\cos^{-1}\left(\frac{R\cos el_2}{R+H}\right) - el_2\right] \quad (13)$$

$$ELON = \tan^{-1}\left(\frac{k_1\cos SLON_2 - k_2\cos SLON_1}{k_1\sin SLON_2 - k_2\sin SLON_1}\right) \quad (14)$$

$$ELAT = \cos^{-1}\left(\frac{k_1}{\cos(ELON - SLON_1)}\right) \quad (15)$$

At stage 2405, new estimated azimuth angles ($AZ_1$ and $AZ_2$) are also calculated for both satellites (S1 and S2) from the revised values of ELON and ELAT using equation (8) above.

At stage 2406, the system tests whether the estimated azimuth angles of both satellites ($AZ_1$ and $AZ_2$) are within predetermined tolerances of the actual azimuth angles ($az_1$ and $az_2$) found in the search procedures. If the estimated azimuths of both satellites are equal to their actual azimuths ($AZ_1$=$az_1$ and $AZ_2$=$az_2$), then case (a) exists and all estimated data is also correct. At stage 2410, the system proceeds to calculate the positions of all remaining satellites from the verified location and bearing data for the antenna mount and the known longitude of each satellite. This procedure is discussed in detail above in sections 7 and 8 and equations (8) through (11).

If $AZ_1 \neq az_1$ or $AZ_2 \neq az_2$, then either case (a) or (b) may exist. If case (a) exists, then a single correction to the bearing (EBRG) will make $AZ_1$=$az_1$ and $AZ_2$=$az_2$. If case (b) exists, then a single correction to the bearing will not be sufficient, and it is indeterminate whether the location or leveling is in error. In the embodiment shown in FIG. 24, the system attempts to determine whether case (a) or (b) exists by adjusting the bearing (EBRG) at stage 2407. For example, EBRG can be incremented by the average of $AZ_1 - az_1$ and $AZ_2 - az_2$. The estimated azimuth angles ($AZ_1$ and $AZ_2$) for both satellites are then recalculated to reflect the revised bearing. At stage 2408, if the recalculated estimated azimuths of both satellites are still not within the required tolerance of their actual azimuths (i.e., $AZ_1 \neq -az_1$ or $AZ_2 \neq az_2$), then case (b) exists, indicating that the antenna mount is not level. In this situation, the system reverts to the single-satellite procedure discussed above (stage 2409).

The present invention is not to be limited by the description of the above exemplary embodiment. The configuration of the system of the present invention encompasses other embodiments and variations as well as a number of differing applications within the scope of the present inventive concept as set forth in the following claims.

We claim:

1. An automated method for positioning a satellite dish antenna mounted on the roof of a parked vehicle in order to receive signals from any of a plurality of geosynchronous satellites, said vehicle having a magnetic compass for providing a magnetic bearing signal and a receiver connected to receive signals from said satellite dish antenna, said method comprising:

generating said magnetic bearing signal from said magnetic compass;

providing an estimated latitude and longitude for said vehicle;

calculating estimated elevations and azimuths of a first geosynchronous satellite and a second geosynchronous satellite relative to said vehicle based on said bearing signal and said estimated latitude and longitude for said vehicle;

moving said satellite dish antenna in the azimuth and elevation directions to a first initial search position corresponding to said estimated position of said first satellite;

incrementally moving said satellite dish antenna in a search pattern in said azimuth and elevation directions until said receiver detects a signal peak for a selected channel of said first satellite;

calculating the actual azimuth and actual elevation of said first satellite relative to said vehicle based on the position of said satellite dish antenna upon detecting said signal peak;

moving said satellite dish antenna in the azimuth and elevation directions to a second initial search position corresponding to said estimated position of said second satellite;

incrementally moving said satellite dish antenna in a search pattern in said azimuth and elevation directions until said receiver detects a signal peak for a selected channel of said second satellite;

calculating the actual azimuth and actual elevation of said second satellite relative to said vehicle based on the position of said satellite dish antenna upon detecting said signal peak;

calculating revised bearing, latitude, and longitude coordinates for said vehicle based on said actual azimuths and actual elevations of said first and second satellites; and calculating azimuths and elevations of any remaining geosynchronous satellites based on said revised bearing, latitude and longitude coordinates for said vehicle.

2. The method of claim 1 wherein said step of providing an estimated latitude and longitude for said vehicle comprises the steps of:

storing a plurality of geographic locations;

displaying said plurality of geographic locations; and providing estimated latitude and longitude coordinates in response to selection of one of said displayed geographic locations.

3. The method of claim 1 wherein said selected channel of said first and second satellites comprises a selected audio subcarrier frequency that is not present in the corresponding selected channels of other satellites near said first and second satellites.

4. The method of claim 1 wherein calculating revised bearing, latitude, and longitude coordinates for said vehicle comprises the following steps:

computing the difference between said actual elevation and said estimated elevation for said first satellite, and the difference between said actual elevation and said estimated elevation for said second satellite;

if said differences in elevation exceed a predetermined limit, calculating revised latitude and longitude coordinates for said vehicle based on said actual azimuths and actual elevations of said first and second satellites;

computing the difference between said actual azimuth and said estimated azimuth for said first satellite, and the difference between said actual azimuth and said estimated azimuth for said second satellite; and if said differences in azimuth exceed a predetermined limit, calculating a revised bearing for said vehicle based on said actual azimuths of said first and second satellites.

5. The method of claim 4 wherein, if a revised bearing for said vehicle cannot be calculated within said predetermined limit consistent with said actual azimuths of said first and second satellites, a revised bearing is calculated based on said actual azimuth of a selected one of said first and second satellites.

6. An automated method for positioning a satellite dish antenna mounted on the roof of a parked vehicle in order to receive signals from any of a plurality of geosynchronous satellites, said vehicle having a magnetic compass for providing a magnetic bearing signal and a receiver connected to receive signals from said satellite dish antenna, said method comprising:

generating said magnetic bearing signal from said magnetic compass;

generating an estimated latitude and longitude for said vehicle from an approximate geographic location of said vehicle;

calculating estimated elevations and azimuths of a first geosynchronous satellite and a second geosynchronous satellite relative to said vehicle based on said bearing signal and said estimated latitude and longitude for said vehicle;

moving said satellite dish antenna in the azimuth and elevation directions to a first initial search position corresponding to said estimated position of said first satellite;

incrementally moving said satellite dish antenna in a search pattern in said azimuth and elevation directions until said receiver detects a signal peak for a selected channel of said first satellite;

calculating the actual azimuth and actual elevation of said first satellite relative to said vehicle based on the position of said satellite dish antenna upon detecting said signal peak;

moving said satellite dish antenna in the azimuth and elevation directions to a second initial search position corresponding to said estimated position of said second satellite;

incrementally moving said satellite dish antenna in a search pattern in said azimuth and elevation directions until said receiver detects a signal peak for a selected channel of said second satellite;

calculating the actual azimuth and actual elevation of said second satellite relative to said vehicle based on the position of said satellite dish antenna upon detecting said signal peak;

computing the difference between said actual elevation and said estimated elevation for said first satellite, and the difference between said actual elevation and said estimated elevation for said second satellite;

if said differences in elevation exceed a predetermined limit, calculating revised latitude and longitude coordinates for said vehicle based on said actual azimuths and actual elevations of said first and second satellites;

computing the difference between said actual azimuth and said estimated azimuth for said first satellite, and the difference between said actual azimuth and said estimated azimuth for said second satellite;

if said differences in azimuth exceed a predetermined limit, calculating a revised bearing for said vehicle based on said actual azimuths of said first and second satellites; and calculating the azimuths and elevations of any remaining geosynchronous satellites based on said revised bearing, latitude, and longitude coordinates for said vehicle.

7. The method of claim 6 wherein said step of providing an estimated latitude and longitude for said vehicle comprises the steps of:

storing a plurality of geographic locations;

displaying said plurality of geographic locations; and providing estimated latitude and longitude coordinates in response to selection of one of said displayed geographic locations.

8. The method of claim 6 wherein said selected channel of said first and second satellites comprises a selected audio subcarrier frequency that is not present in the corresponding selected channels of other satellites near said first and second satellites.

9. The method of claim 6 wherein, if a revised bearing for said vehicle cannot be calculated within said predetermined limit consistent with said actual azimuths of said first and second satellites, a revised bearing is calculated based on said actual azimuth of a selected one of said first and second satellites.

10. An automated method for positioning a satellite dish antenna mounted on the roof of a parked vehicle in order to receive signals from any of a plurality of geosynchronous satellites, said vehicle having a magnetic compass for providing a magnetic bearing signal and a receiver connected to receive signals from said satellite dish antenna, said method comprising:

generating said magnetic bearing signal from said magnetic compass;

displaying a plurality of geographic locations, wherein each geographic location is associated with an estimated latitude and longitude coordinates;

selecting one of said geographic locations from said display;

calculating estimated elevations and azimuths for a first geosynchronous satellite and a second geosynchronous satellite relative to said vehicle based on said bearing signal and said estimated latitude and longitude for said geographic location;

moving said satellite dish antenna in the azimuth and elevation directions to a first initial search position corresponding to said estimated position of said first satellite;

incrementally moving said satellite dish antenna in a search pattern in said azimuth and elevation directions until said receiver detects a signal peak for a selected channel of said first satellite;

calculating the actual azimuth and actual elevation of said first satellite relative to said vehicle based on the position of said satellite dish antenna upon detecting said signal peak;

moving said satellite dish antenna in the azimuth and elevation directions to a second initial search position corresponding to said estimated position of said second satellite;

incrementally moving said satellite dish antenna in a search pattern in said azimuth and elevation directions until said receiver detects a signal peak for a selected channel of said second satellite;

calculating the actual azimuth and actual elevation of said second satellite relative to said vehicle based on the position of said satellite dish antenna upon detecting said signal peak;

calculating revised bearing, latitude, and longitude coordinates for said vehicle based on said actual azimuths and actual elevations of said first and second satellites; and calculating the azimuths and elevations of any remaining geosynchronous satellites based on said revised bearing, latitude, and longitude coordinates for said vehicle.

11. The method of claim 10 wherein calculating revised bearing, latitude, and longitude coordinates for said vehicle comprises the following steps:

computing the difference between said actual elevation and said estimated elevation for said first satellite, and the difference between said actual elevation and said estimated elevation for said second satellite;

if said differences in elevation exceed a predetermined limit, calculating revised latitude and longitude coordinates for said vehicle based on said actual azimuths and actual elevations of said first and second satellites;

computing the difference between said actual azimuth and said estimated azimuth for said first satellite, and the difference between said actual azimuth and said estimated azimuth for said second satellite; and if said differences in azimuth exceed a predetermined limit, calculating a revised bearing for said vehicle based on said actual azimuths of said first and second satellites.

12. The method of claim 11 wherein, if a revised bearing for said vehicle cannot be calculated within said predetermined limit consistent with said actual azimuths of said first and second satellites, a revised bearing is calculated based on said actual azimuth of a selected one of said first and second satellites.

13. The method of claim 10 wherein said selected channel of said first and second satellites comprises a selected audio subcarrier frequency that is not present in the corresponding selected channels of other satellites near said first and second satellites.

* * * * *

UNITED STATES PATENT AND TRADEMARK OFFICE

CERTIFICATE OF CORRECTION

PATENT NO. : 5,585,804

DATED : December 17, 1996

INVENTOR(S) : Rodeffer

It is certified that error appears in the above-indentified patent and that said Letters Patent is hereby corrected as shown below:

In the drawings:

FIG. 11(b), replace "1100" with "1110"

column 1, line 11, replace "8/978,289" with --07/978,289-- column 8, line 49, replace "340" with --400-- column 11, line 32, delete "where:"

column 12, line 1, delete "E = "

column 12, line 27, replace "of x of" with --of x-- column 12, line 33, replace "actuator" with --elevation-- column 12, line 35, replace "100" with --1100-- column 12, line 38, replace "100" with --1100-- column 12, line 47, replace "I" with --l-- column 13, line 21, replace "≦0≦" with "≦θ≦"

column 16, line 12, replace ",," with --,-- column 16, line 29, replace "rough tune" with --rough-tune-- column 17, line 67, replace "$P_v + 90$" with --$P_v - 90$-- column 18, line 32, replace "$\alpha_{A = \alpha B = \alpha c}$" with --$\alpha_A = \alpha_B = \alpha_C$-- column 18, line 33, replace "$\Delta\beta = \beta_{c - \beta A}$" with --$\Delta\beta = \beta_C - \beta_A$-- column 19, line 34, replace "4 - 21" with --14 - 21-- column 19, line 43, replace "$az^2$" with --$az_2$-- column 20, line 1, replace "≠or" with --or--

UNITED STATES PATENT AND TRADEMARK OFFICE

CERTIFICATE OF CORRECTION

PATENT NO. : 5,585,804

DATED : December 17, 1996

INVENTOR(S) : Rodeffer

It is certified that error appears in the above-indentified patent and that said Letters Patent is hereby corrected as shown below:

column 20, line 50, replace "$AZ_1 \neq -az_1$" with --$AZ_1 \neq az_1$--

Signed and Sealed this

Twenty-sixth Day of August, 1997

*Attest:*

Bruce Lehman

BRUCE LEHMAN

*Attesting Officer*

*Commissioner of Patents and Trademarks*